US007574153B2

(12) United States Patent
Nakayama et al.

(10) Patent No.: US 7,574,153 B2
(45) Date of Patent: Aug. 11, 2009

(54) IMAGE FORMING METHOD AND APPARATUS INCLUDING ADJUSTABLE CONVEYANCE SPEED TO PREVENT IMAGE SHOCK JITTER

(75) Inventors: Takahiro Nakayama, Yokohama (JP); Masahiko Satoh, Machida (JP); Akira Shinshi, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 131 days.

(21) Appl. No.: 11/560,173

(22) Filed: Nov. 15, 2006

(65) Prior Publication Data

US 2007/0110464 A1 May 17, 2007

(30) Foreign Application Priority Data

Nov. 15, 2005 (JP) ..... 2005-330266

(51) Int. Cl.
*G03G 15/16* (2006.01)
*G03G 15/00* (2006.01)

(52) U.S. Cl. ..... 399/45; 399/66; 399/67; 399/68; 399/167

(58) Field of Classification Search ..... 399/68, 399/75, 45, 44, 101, 396
See application file for complete search history.

(56) References Cited

U.S. PATENT DOCUMENTS 5,159,393 A * 10/1992 Hiroshima et al. ..... 399/313
5,722,026 A * 2/1998 Goto et al. ..... 399/333
6,301,452 B1 * 10/2001 Yoshizawa ..... 399/45
6,434,344 B1 * 8/2002 Yoshida et al. ..... 399/44
6,577,843 B2 * 6/2003 Akita et al. ..... 399/396
6,816,685 B2 * 11/2004 Eda ..... 399/16
2002/0150413 A1 10/2002 Akita et al.

(Continued)

FOREIGN PATENT DOCUMENTS

JP 08-179636 7/1996

(Continued)

OTHER PUBLICATIONS

U.S. Appl. No. 11/934,981, filed Nov. 5, 2007, Furuya, et al.

(Continued)

*Primary Examiner*—David M Gray
*Assistant Examiner*—G. M. Hyder
(74) *Attorney, Agent, or Firm*—Oblon, Spivak, McClelland, Maier & Neustadt, P.C.

(57) ABSTRACT

An image forming method includes forming a toner image on an image carrier of an image forming apparatus, transferring the toner image on the image carrier onto an intermediate transfer member, and second-transferring the toner image on the intermediate transfer member rotating at a linear speed Vc onto a recording medium, which is fed along a first conveyance path from a registration roller pair rotating at a linear speed Vr, by a transfer member. The toner image is fixed onto the recording medium, which is fed along a second conveyance path from the transfer member, by a fixing member rotating at a linear speed Vt. A length of the first and second conveyance paths is shorter than a length of a maximum recording medium of the image forming apparatus. Linear speed ratios Vc/Vt and Vr/Vc are changed depending on a property of the recording medium to prevent shock jitters.

19 Claims, 8 Drawing Sheets

U.S. PATENT DOCUMENTS

2007/0009284 A1* 1/2007 Okamoto et al. ..... 399/101
2007/0059071 A1* 3/2007 Shinshi et al. ..... 399/400

FOREIGN PATENT DOCUMENTS

JP 11-024339 1/1999
JP 2002-287444 10/2002
JP 2003-084643 3/2003

OTHER PUBLICATIONS

U.S. Appl. No. 12/049,838, filed Mar. 17, 2008, Senoh et al.

* cited by examiner

IMAGE FORMING METHOD AND APPARATUS INCLUDING ADJUSTABLE CONVEYANCE SPEED TO PREVENT IMAGE SHOCK JITTER

CROSS-REFERENCE TO RELATED APPLICATION

The present application is based on and claims priority to Japanese patent application No. 2005-330266 filed on Nov. 15, 2005 in the Japan Patent Office, the entire contents of which are hereby incorporated herein by reference.

BACKGROUND OF THE INVENTION

1. Field of the Invention

Exemplary aspects of the present invention relate to an image forming method and an image forming apparatus, and more particularly to an image forming method and an image forming apparatus for feeding a recording medium of various types on a conveyance path extending from a registration roller pair to a fixing member, the conveyance path being shorter than a maximum length of the recording medium handled by the image forming apparatus.

2. Description of the Related Art

A related art image forming apparatus, such as a copying machine, a facsimile machine, a printer, or a multifunction printer having copying, printing, scanning, and facsimile functions, forms an electrostatic latent image on a photoconductor according to image data. The electrostatic latent image is developed with a developer (e.g., a toner) to form a toner image on the photoconductor. The toner image is transferred from the photoconductor onto an intermediate transfer member. The intermediate transfer member contacts a transfer roller to form a transfer nip therebetween. At the transfer nip, the toner image is further transferred from the intermediate transfer member onto a recording medium (e.g., a sheet) fed by a registration roller pair and nipped by the intermediate transfer member and the transfer roller. The sheet bearing the toner image is sent to a fixing nip formed by a fixing member and a pressing member contacting each other. When the sheet bearing the toner image is nipped by the fixing member and the pressing member at the fixing nip, the fixing member and the pressing member apply heat and pressure to the sheet bearing the toner image to fix the toner image on the sheet. The sheet bearing the fixed toner image is output onto an output tray.

The registration roller pair forms a registration nip to nip the sheet. At the registration nip, the rotating registration roller pair feeds the sheet toward the transfer nip. At the transfer nip, the rotating intermediate transfer member feeds the sheet toward the fixing nip. At the fixing nip, one of the rotating fixing member and the rotating pressing member feeds the sheet toward the output tray.

When a sheet having a maximum size that the image forming apparatus can handle is used, the sheet may be fed while simultaneously nipped at the registration nip, the transfer nip, and the fixing nip. In order to stably feed a sheet under such situation, an example of a related art image forming apparatus is proposed in which the linear speed Vr of the rotating registration roller pair is set to be slower than the linear speed Vc of the rotating intermediate transfer member. Further, the linear speed Vc of the rotating intermediate transfer member is set to be slower than the linear speed Vt of the rotating fixing member. Thus, a back tension can be applied to a sheet and thereby the sheet can be stably conveyed without being skewed. The linear speed Vr of the registration roller pair and the linear speed Vt of the fixing member can also be changed in accordance with the size and the slip rate of the sheet, while the above-described relationship among the linear speeds Vr, Vc, and Vt is maintained. Thus, a proper back tension can be applied to the sheet in accordance with the size and the slip rate of the sheet, and thereby formation of defective images due to an error in scaling of a toner image and/or a skew of the sheet can be suppressed.

Even when the linear speed Vr of the registration roller pair and the linear speed Vt of the fixing member are changed in accordance with the size and the slip rate of a sheet, a defective toner image having a black line (i.e., shock jitter) extending in a main scanning direction may be formed on the sheet when the thickness of the sheet is changed.

Shock jitter is formed on the second or succeeding sheet when a toner image is continuously formed on a plurality of sheets while the linear speed Vt of the fixing member is substantially faster than the linear speed Vc of the intermediate transfer member. Specifically, the foremost head of a sheet enters the fixing nip while the sheet is bent. When the linear speed Vt of the fixing member is substantially faster than the linear speed Vc of the intermediate transfer member, the fixing member feeds the sheet faster than the intermediate transfer member. As a result, the sheet, which is simultaneously nipped at the fixing nip and the transfer nip, is not bent but is stretched in a sheet conveyance direction before the tail of the sheet passes the transfer nip. The stretched sheet is conveyed at the transfer nip at the linear speed Vt of the fixing member. The sheet conveyed at the linear speed Vt of the fixing member causes the intermediate transfer member to rotate at the linear speed Vt of the fixing member. After the tail of the sheet passes the transfer nip, the intermediate transfer member is rotated by a driving force of a driver for driving the intermediate transfer member. However, the driving force is not immediately transmitted to the intermediate transfer member due to backlash of the driver and thereby the intermediate transfer member temporarily stops rotating. When a toner image is transferred from the photoconductor onto the intermediate transfer member while the intermediate transfer member temporarily stops rotating, shock jitter may be formed on the transferred toner image. The toner image having shock jitter is further transferred from the intermediate transfer member onto the second or succeeding sheet. When a thick sheet is used, the foremost head of the thick sheet enters the fixing nip while the sheet is hardly bent. Therefore, when the thick sheet is conveyed at the same linear speed ratio Vc/Vt as a plain paper sheet, the thick sheet is stretched between the transfer nip and the fixing nip quicker than the plain paper sheet. As a result, shock jitter may be formed on a toner image transferred on the second or succeeding thick sheet.

When the linear speed Vc of the intermediate transfer member is faster than the linear speed Vr of the registration roller pair, a shrunk toner image may be formed when a plain paper sheet is used. Specifically, the plain paper sheet is stretched between the registration nip and the transfer nip and thereby is conveyed at the transfer nip at the linear speed Vr of the registration roller pair instead of the linear speed Vc of the intermediate transfer member. Namely, the plain paper sheet is conveyed at the transfer nip at a speed slower than the linear speed Vc of the intermediate transfer member. As a result, a shrunk toner image is formed onto the plain paper sheet. When the linear speed Vc of the intermediate transfer member is set to be slower than the linear speed Vr of the registration roller pair to prevent formation of the shrunk toner image on the plain paper sheet, shock jitter may be formed on a toner image on the tail of a thick sheet when the thick sheet is used.

BRIEF SUMMARY OF THE INVENTION

This specification describes below an image forming method according to an exemplary embodiment of the invention. In one aspect of the present invention, the image forming method includes forming a toner image on an image carrier of an image forming apparatus, transferring the toner image on the image carrier onto an intermediate transfer member, and second-transferring the toner image on the intermediate transfer member rotating at a linear speed Vc onto a recording medium, which is fed along a first conveyance path from a registration roller pair rotating at a linear speed Vr, by a transfer member. The image forming method further includes fixing the toner image on the recording medium, which is fed along a second conveyance path from the transfer member, by a fixing member rotating at a linear speed Vt. A length of the first and second conveyance paths is shorter than a length of a maximum recording medium of the image forming apparatus. Linear speed ratios Vc/Vt and Vr/Vc are changed depending on a property of the recording medium.

This specification further describes below an image forming apparatus according to an exemplary embodiment of the invention. In one aspect of the present invention, the image forming apparatus includes an image carrier, an intermediate transfer member, a registration roller pair, a first conveyance path, a transfer member, a fixing member, and a second conveyance path. The image carrier is configured to carry a toner image. The intermediate transfer member is configured to carry the toner image transferred from the image carrier and to rotate at a linear speed Vc. The registration roller pair is configured to rotate at a linear speed Vr and to feed a recording medium to the intermediate transfer member. The first conveyance path is configured to convey the recording medium fed by the registration roller pair to the intermediate transfer member. The transfer member is configured to transfer the toner image on the intermediate transfer member onto the recording medium. The fixing member is configured to fix the toner image on the recording medium and to rotate at a linear speed Vt. The second conveyance path is configured to convey the recording medium bearing the toner image from the intermediate transfer member to the fixing member. A length of the first and second conveyance paths is shorter than a length of a maximum recording medium of the image forming apparatus. Linear speed ratios Vc/Vt and Vr/Vc are changed depending on a property of the recording medium.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
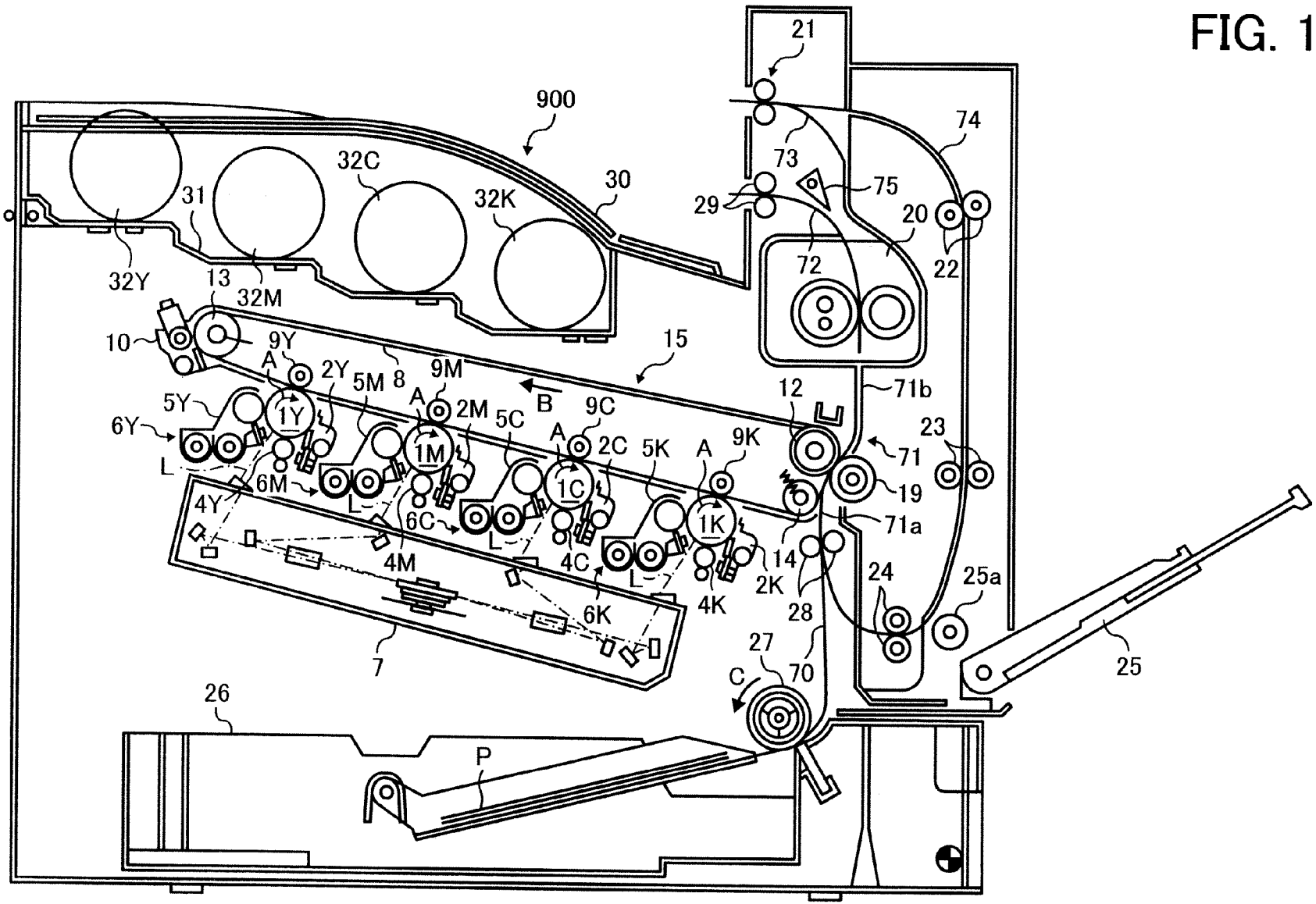
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 900 according to an exemplary embodiment of the present invention is explained.

As illustrated in FIG. 1, the image forming apparatus 900 includes process units 6Y, 6M, 6C, and 6K, an optical writer 7, a toner bottle base 31, toner bottles 32Y, 32M, 32C, and 32K, a transfer unit 15, a paper tray 26, feeding rollers 27 and 25*a*, a sheet feeding path 70, a bypass tray 25, a registration roller pair 28, a conveyance path 71, a fixing unit 20, an output path 72, a pre-reverse conveyance path 73, a switching nail 75, an output roller pair 29, an output tray 30, a reverse roller pair 21, a reverse conveyance path 74, a first reverse conveying roller pair 22, a second reverse conveying roller pair 23, and a third reverse conveying roller pair 24. The conveyance path 71 includes a first conveyance path 71*a* and a second conveyance path 71*b*.

The process unit 6Y includes a photoconductor 1Y, a charger 4Y, a development unit 5Y, and a cleaner 2Y. The process unit 6M includes a photoconductor 1M, a charger 4M, a development unit 5M, and a cleaner 2M. The process unit 6C includes a photoconductor 1C, a charger 4C, a development unit 5C, and a cleaner 2C. The process unit 6K includes a photoconductor 1K, a charger 4K, a development unit 5K, and a cleaner 2K. The transfer unit 15 includes an intermediate transfer belt 8, four first transfer bias rollers 9Y, 9M, 9C, and 9K, a second transfer backup roller 12, a cleaner backup roller 13, a tension roller 14, a second transfer bias roller 19, and a cleaner 10.

The image forming apparatus 900 can be a copying machine, a facsimile machine, a printer, a multifunction printer having copying, printing, scanning, and facsimile functions, or the like. According to this non-limiting exemplary embodiment of the present invention, the image forming apparatus 900 functions as a color printer for printing a color image on a recording medium by an electrophotographic method.

The process units 6Y, 6M, 6C, and 6K respectively form toner images in yellow, magenta, cyan, and black colors. The process units 6Y, 6M, 6C, and 6K are attachable to and detachable from the image forming apparatus 900. Thus, each of the process units 6Y, 6M, 6C, and 6K can be replaced with a new one when the process unit 6Y, 6M, 6C, or 6K is at the end of its life. The process units 6Y, 6M, 6C, and 6K use toners of different colors from each other as a developer, but have a common structure.

The photoconductors 1Y, 1M, 1C, and 1K have a drum shape and serve as an image carrier. The photoconductors 1Y, 1M, 1C, and 1K are driven by a driver (not shown) to rotate in a rotating direction A. The chargers 4Y, 4M, 4C, and 4K, the development units 5Y, 5M, 5C, and 5K, and the cleaners 2Y, 2M, 2C, and 2K are respectively disposed around the photoconductors 1Y, 1M, 1C, and 1K. The chargers 4Y, 4M, 4C, and 4K uniformly charge surfaces of the photoconductors 1Y, 1M, 1C, and 1K respectively.

The optical writer 7 is disposed under the process units 6Y, 6M, 6C, and 6K and emits light L (e.g., a laser beam) onto each of the charged surfaces of the photoconductors 1Y, 1M, 1C, and 1K according to image data. Thus, electrostatic latent images corresponding to yellow, magenta, cyan, and black image data are respectively formed on the surfaces of the photoconductors 1Y, 1M, 1C, and 1K. In the optical writer 7, a laser beam emitted from a light source (not shown) is scanned by a polygon mirror (not shown) rotatably driven by a motor (not shown). The laser beam is irradiated onto each of the surfaces of the photoconductors 1Y, 1M, 1C, and 1K via a plurality of optical lenses and mirrors (not shown).

The toner bottle base 31 is disposed above the transfer unit 15 and under the output tray 30. The toner bottles 32Y, 32M, 32C, and 32K are arranged on the toner bottle base 31 and respectively contain yellow, magenta, cyan, and black toners. The toner bottles 32Y, 32M, 32C, and 32K are arranged on an oblique plane slightly slanted with respect to the horizontal plane. The toner bottle 32C is positioned at a higher level than the toner bottle 32K. The toner bottle 32M is positioned at a higher level than the toner bottle 32C. The toner bottle 32Y is positioned at a higher level than the toner bottle 32M. The yellow, magenta, cyan, and black toners are respectively supplied by toner conveying devices (not shown) from the toner bottles 32Y, 32M, 32C, and 32K to the development units 5Y, 5M, 5C, and 5K of the process units 6Y, 6M, 6C, and 6K. The toner bottles 32Y, 32M, 32C, and 32K are attachable to and detachable from the image forming apparatus 900 separately from the process units 6Y, 6M, 6C, and 6K.

The development units 5Y, 5M, 5C, and 5K respectively develop the electrostatic latent images formed on the surfaces of the photoconductors 1Y, 1M, 1C, and 1K with developers respectively containing magnetic carriers and yellow, magenta, cyan, and black toners to form yellow, magenta, cyan, and black toner images.

The transfer unit 15 is disposed above the process units 6Y, 6M, 6C, and 6K. The intermediate transfer belt 8 has an endless belt shape and serves as an intermediate transfer member. The intermediate transfer belt 8 is looped over the first transfer bias rollers 9Y, 9M, 9C, and 9K, the second transfer backup roller 12, the cleaner backup roller 13, and the tension roller 14. At least one of the first transfer bias rollers 9Y, 9M, 9C, and 9K, the second transfer backup roller 12, the cleaner backup roller 13, and the tension roller 14 drives and rotates the intermediate transfer belt 8 in a rotating direction B. The first transfer bias rollers 9Y, 9M, 9C, and 9K respectively oppose the photoconductors 1Y, 1M, 1C, and 1K via the intermediate transfer belt 8 to form first transfer nips between the photoconductors 1Y, 1M, 1C, and 1K and the intermediate transfer belt 8. A transfer bias having a polarity (e.g., positive) opposite to the polarity of the toner is applied to an inner circumferential surface of the intermediate transfer belt 8. The rollers other than the first transfer bias rollers 9Y, 9M, 9C, and 9K are grounded. While the intermediate transfer belt 8 rotates, the first transfer bias rollers 9Y, 9M, 9C, and 9K respectively transfer the yellow, magenta, cyan, and black toner images formed on the surfaces of the photoconductors 1Y, 1M, 1C, and 1K onto an outer circumferential surface of the rotating intermediate transfer belt 8 at the first transfer nips. Thus, the yellow, magenta, cyan, and black toner images are superimposed on the outer circumferential surface of the intermediate transfer belt 8. The second transfer backup roller 12 opposes the second transfer bias roller 19 via the intermediate transfer belt 8 to form a second transfer nip between the second transfer bias roller 19 and the intermediate transfer belt 8.

The cleaners 2Y, 2M, 2C, and 2K respectively remove residual toners remaining on the surfaces of the photoconductors 1Y, 1M, 1C, and 1K after the yellow, magenta, cyan, and black toner images respectively formed on the surfaces of the photoconductors 1Y, 1M, 1C, and 1K are transferred onto the outer circumferential surface of the intermediate transfer belt 8. Then, dischargers (not shown) remove residual electric charge remaining on the surfaces of the photoconductors 1Y, 1M, 1C, and 1K after the cleaners 2Y, 2M, 2C, and 2K respectively clean the surfaces of the photoconductors 1Y, 1M, 1C, and 1K. Thus, the surfaces of the photoconductors 1Y, 1M, 1C, and 1K are initialized to become ready for next image forming processing.

The paper tray 26 is disposed under the optical writer 7 and loads a recording medium (e.g., sheets P). The feeding roller 27 contacts an uppermost sheet P of the sheets P loaded on the paper tray 26. When a driver (not shown) rotates the feeding roller 27 in a rotating direction C, the rotating feeding roller 27 feeds the uppermost sheet P toward the sheet feeding path 70 extending from the feeding roller 27 to the registration roller pair 28.

The bypass tray 25 is disposed on one side of the image forming apparatus 900 and loads a recording medium (e.g., sheets P) such as a thick sheet, a postcard, and an OHP (overhead projector) transparency. The feeding roller 25*a* feeds an uppermost sheet P of the sheets P loaded on the bypass tray 25 toward the third reverse conveying roller pair 24. The third reverse conveying roller pair 24 further feeds the sheet P toward the registration roller pair 28.

The registration roller pair 28 is disposed at the end of the sheet feeding path 70. The registration roller pair 28 forms a registration nip to nip the sheet P fed by the feeding roller 27 or the third reverse conveying roller pair 24. The registration roller pair 28 rotates to nip the sheet P at the registration nip. However, the registration roller pair 28 temporarily stops rotating as soon as the registration roller pair 28 nips the sheet P, and then resumes rotating to feed the sheet P to the second transfer nip at a proper time.

The second transfer bias roller 19 transfers the yellow, magenta, cyan, and black toner images superimposed on the outer circumferential surface of the intermediate transfer belt 8 onto the sheet P at the second transfer nip. Thus, a color toner image is formed on the sheet P. The cleaner 10 removes residual toners remaining on the outer circumferential surface of the intermediate transfer belt 8 after the yellow, magenta, cyan, and black toner images superimposed on the outer circumferential surface of the intermediate transfer belt 8 are transferred onto the sheet P at the second transfer nip. The conveyance path 71 extends from the registration nip to a fixing nip formed in the fixing unit 20 via the second transfer nip. The first conveyance path 71*a* extends from the registration nip to the second transfer nip. The second conveyance path 71*b* extends from the second transfer nip to the fixing nip. The sheet P bearing the color toner image is fed by the second transfer bias roller 19 and the intermediate transfer belt 8 toward the fixing unit 20 via the second conveyance path 71*b*.

In the fixing unit 20, a fixing member (not shown) and a pressing member (not shown), which may serve as a fixing member, contact each other to form the fixing nip therebetween. A heat generating source (not shown), such as a halogen lamp, is disposed inside the fixing member. The pressing member contacts the fixing member and applies a predetermined pressure to the fixing member. The fixing member and the pressing member rotate to nip the sheet P while the color toner image on the sheet P contacts the fixing member. The fixing member and the pressing member apply heat and pressure to the sheet P bearing the color toner image while the sheet P is conveyed through the fixing nip so as to melt the toner forming the color toner image and to fix the color toner image on the sheet P.

The output path 72 extends from the fixing nip to the output roller pair 29. The pre-reverse conveyance path 73 branches from the output path 72 and extends to the reverse roller pair 21. The switching nail 75 is swingably disposed at a node formed by the output path 72 and the pre-reverse conveyance path 73. The switching nail 75 swings to guide the sheet P bearing the fixed color toner image fed by the fixing member and the pressing member toward the output roller pair 29 or the reverse roller pair 21. Specifically, the switching nail 75 moves its head closer to the pre-reverse conveyance path 73 to guide the sheet P toward the output roller pair 29. The switching nail 75 moves its head away from the pre-reverse conveyance path 73 to guide the sheet P toward the reverse roller pair 21.

When the switching nail 75 moves its head closer to the pre-reverse conveyance path 73, the sheet P is conveyed on the output path 72 to the output roller pair 29. The output roller pair 29 feeds the sheet P onto the output tray 30. The output tray 30 is disposed on top of the image forming apparatus 900. The sheet P fed by the output roller pair 29 is stacked one by one on the output tray 30. When the switching nail 75 moves its head away from the pre-reverse conveyance path 73, the sheet P is conveyed on the pre-reverse conveyance path 73 to the reverse roller pair 21. When the sheet P enters a nip formed by the reverse roller pair 21, the reverse roller pair 21 feeds the sheet P toward the output tray 30. However, immediately before the tail of the sheet P enters the nip formed by the reverse roller pair 21, the reverse roller pair 21 rotates in an opposite direction. As a result, the tail of the sheet P enters the reverse conveyance path 74.

The reverse conveyance path 74 has a curved shape and extends from the reverse roller pair 21 to the registration roller pair 28. The first reverse conveying roller pair 22, the second reverse conveying roller pair 23, and the third reverse conveying roller pair 24 are provided on the reverse conveyance path 74. The sheet P is reversed while it is fed by the first reverse conveying roller pair 22, the second reverse conveying roller pair 23, and the third reverse conveying roller pair 24. The reversed sheet P returns to the first conveyance path 71*a* and enters the second transfer nip again. When the sheet P enters the second transfer nip, the backside of the sheet P, on which a toner image is not yet transferred, contacts the intermediate transfer belt 8. The second transfer bias roller 19 transfers toner images superimposed on the outer circumferential surface of the intermediate transfer belt 8 onto the backside of the sheet P. Then, the sheet P bearing a color toner image on its both sides is fed onto the output tray 30 via the second conveyance path 71*b*, the fixing unit 20, the output path 72, and the output roller pair 29.

When a telephone line (not shown) is connected to the image forming apparatus 900, the image forming apparatus 900 can be used as a facsimile machine. When the image forming apparatus 900 is provided with a scanner (not shown), the image forming apparatus 900 can be used as a copying machine.

Figure 2:
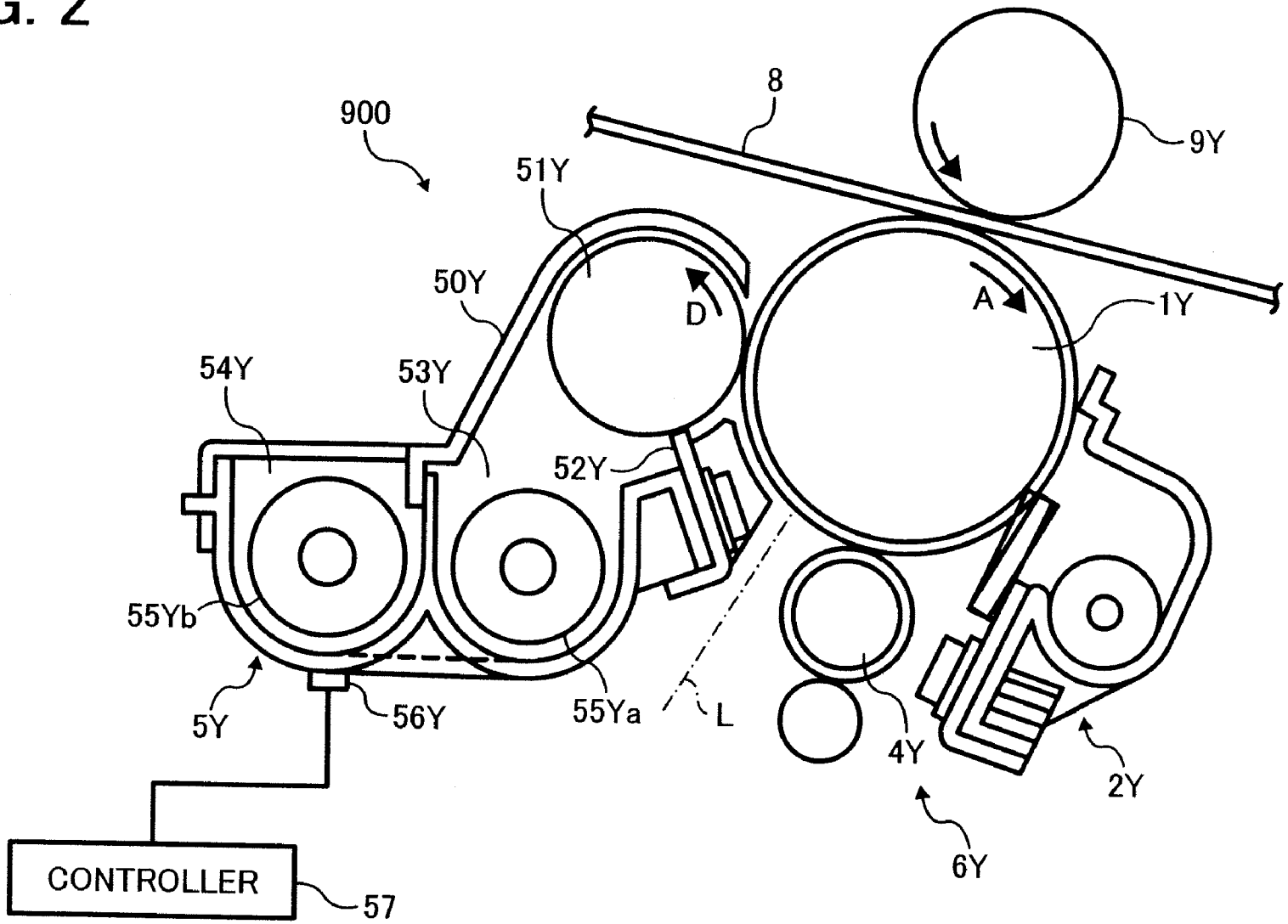
FIG. 2 is a schematic view of a process unit included in the image forming apparatus shown in FIG. 1.

FIG. 2 illustrates the structure of the process unit 6Y, which is common to the process units 6M, 6C, and 6K (depicted in FIG. 1). As illustrated in FIG. 2, the development unit 5Y of the process unit 6Y includes a casing 50Y, a development roller 51Y, screws 55Ya and 55Yb, a doctor blade member 52Y, a first supplier 53Y, a second supplier 54Y, and a sensor 56Y. The image forming apparatus 900 further includes a controller 57.

The casing 50Y cases the elements of the development unit 5Y. The development roller 51Y is partially cased by the casing 50Y and carries a developer. The two screws 55Ya and 55Yb are disposed in parallel to each other. The casing 50Y contains a yellow developer (not shown) including magnetic carriers and a yellow toner. The screws 55Ya and 55Yb agitate and convey the yellow developer to charge the yellow developer by friction. The charged yellow toner adheres to a surface of the development roller 51Y. The doctor blade member 52Y regulates the layer thickness of the yellow toner carried by the development roller 51Y. The development roller 51Y rotates in a rotating direction D to convey the yellow toner to a development area formed between the development roller 51Y and the photoconductor 1Y opposing each other. At the development area, the yellow toner adheres to an electrostatic latent image formed on the surface of the photoconductor 1Y. Thus, a yellow toner image is formed on the surface of the photoconductor 1Y. After the yellow toner is consumed by development, the rotating development roller 51Y returns the yellow developer into the inside of the casing 50Y.

A wall (not shown) is provided between the screws 55Ya and 55Yb and divides the interior of the casing 50Y into the first supplier 53Y containing the development roller 51Y and the screw 55Ya and the second supplier 54Y containing the screw 55Yb. A driver (not shown) rotatably drives the screw 55Ya. The rotating screw 55Ya conveys the yellow developer in the first supplier 53Y in a longitudinal direction of the development roller 51Y so as to supply the yellow developer to the development roller 51Y. The yellow developer conveyed by the screw 55Ya to an end portion of the first supplier 53Y enters the second supplier 54Y via an opening (not shown) provided on the wall. A driver (not shown) rotatably drives the screw 55Yb. The rotating screw 55Yb conveys the yellow developer conveyed from the first supplier 53Y in the second supplier 54Y in a direction opposite to the direction in which the yellow developer is conveyed by the screw 55Ya in the first supplier 53Y. The yellow developer conveyed by the screw 55Yb to an end portion of the second supplier 54Y enters the first supplier 53Y via another opening (not shown) provided on the wall.

The sensor 56Y includes a permeability sensor and is disposed on a bottom wall of the second supplier 54Y to output a voltage corresponding to a permeability of the yellow developer passing on the bottom wall. A permeability of the two-component developer containing a toner and magnetic carriers correlates well with a toner density. Therefore, the sensor 56Y outputs a voltage corresponding to the density of the yellow toner. The value of the output voltage is sent to the controller 57. The controller 57 includes a RAM (random access memory) storing a reference voltage YVtref for the sensor 56Y. The RAM also stores reference voltages for sensors (not shown) provided in the development units 5M, 5C, and 5K (depicted in FIG. 1). A yellow toner conveying device (not shown) is driven based on the reference voltage YVtref. Specifically, the controller 57 controls driving of the yellow toner conveying device so that the yellow toner conveying device supplies the yellow toner to the second supplier 54Y and the output voltage of the sensor 56Y thereby becomes closer to the reference voltage YVtref. Thus, the density of the yellow toner of the yellow developer in the development unit 5Y is maintained within a predetermined range. In the development units 5M, 5C, and 5K (depicted in FIG. 1), the controller 57 controls driving of magenta, cyan, and black toner conveying devices (not shown).

Figure 3:
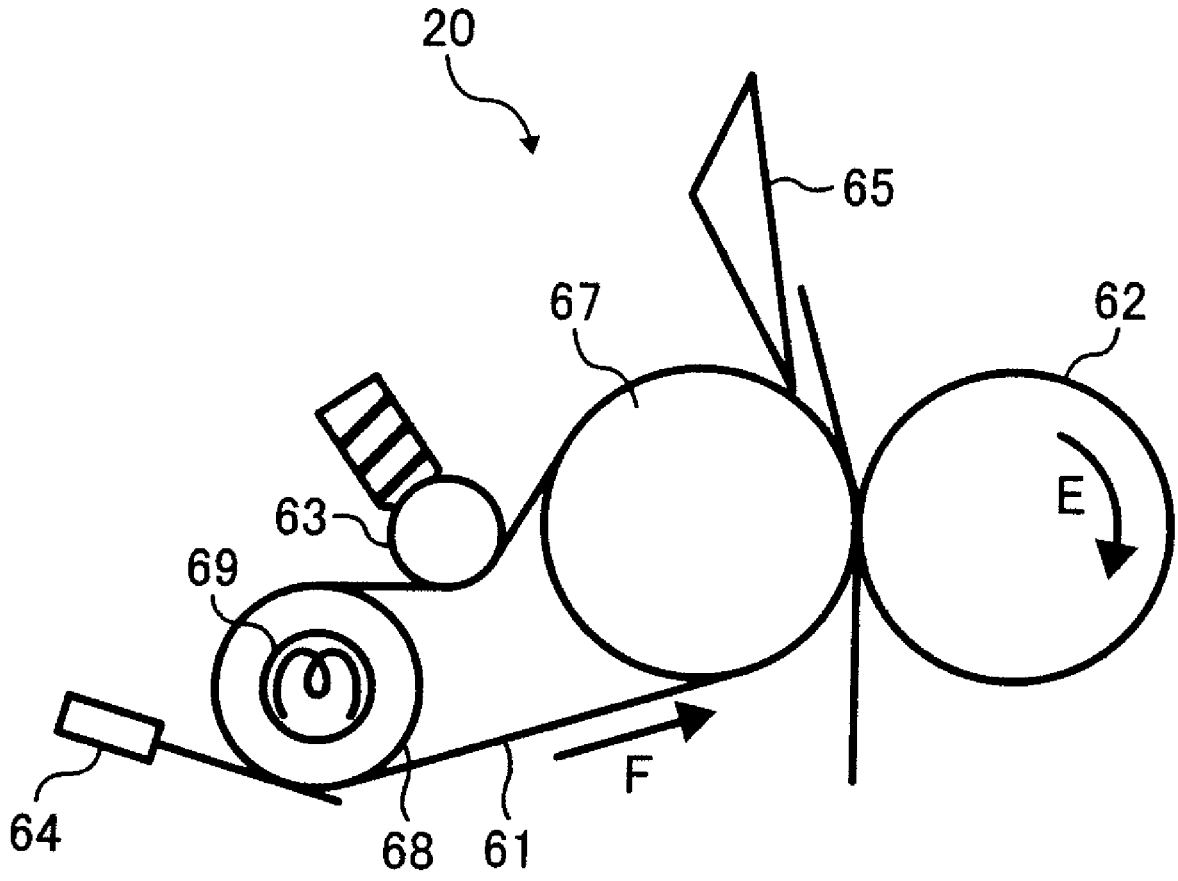
FIG. 3 is a schematic view of a fixing unit included in the image forming apparatus shown in FIG. 1.

As illustrated in FIG. 3, the fixing unit 20 includes a fixing belt 61, a heater 69, a heating roller 68, a fixing roller 67, a tension roller 63, a thermistor 64, a pressing roller 62, and a separating nail 65.

The fixing belt 61 is looped over the fixing roller 67 and the heating roller 68. The heater 69 is disposed inside the heating roller 68 and heats the heating roller 68. The heating roller 68 heats the fixing belt 61 up to a temperature at which an unfixed toner image on a sheet P is softened or melted. According to this non-limiting exemplary embodiment, the fixing belt 61 has a belt shape having a small heat capacity. Thus, the fixing belt 61 can be quickly heated up to the temperature at which the unfixed toner image on the sheet P is softened or melted, resulting in a shortened warm-up time period. The heated fixing belt 61 heats the fixing roller 67. The tension roller 63 contacts an outer circumferential surface of the fixing belt 61 to apply tension to the fixing belt 61 by using a force applier such as a spring. The thermistor 64 detects the temperature of the outer circumferential surface of the fixing belt 61.

The pressing roller 62 opposes and presses the fixing roller 67 via the fixing belt 61 to form a fixing nip between the pressing roller 62 and the fixing belt 61. A driving motor (not shown) drives the pressing roller 62 to rotate in a rotating direction E. The rotating pressing roller 62 rotates the fixing belt 61 in a rotating direction F.

The separating nail 65 is disposed on a downstream side from the fixing nip relative to a sheet conveyance direction. The separating nail 65 separates the foremost head of a sheet P passing the fixing nip from the fixing belt 61.

In a belt type fixing unit according to this non-limiting exemplary embodiment, the fixing belt 61 and the pressing roller 62 nip a sheet P bearing a toner image at the fixing nip and apply heat and pressure to the sheet P to fix the toner image on the sheet P. However, the image forming apparatus 900 may include a roller type fixing unit, in which a fixing roller contacts a pressing roller to form a fixing nip therebetween. The fixing roller and the pressing roller nip a sheet P bearing a toner image at the fixing nip and apply heat and pressure to the sheet P to fix the toner image on the sheet P.

Figure 4:
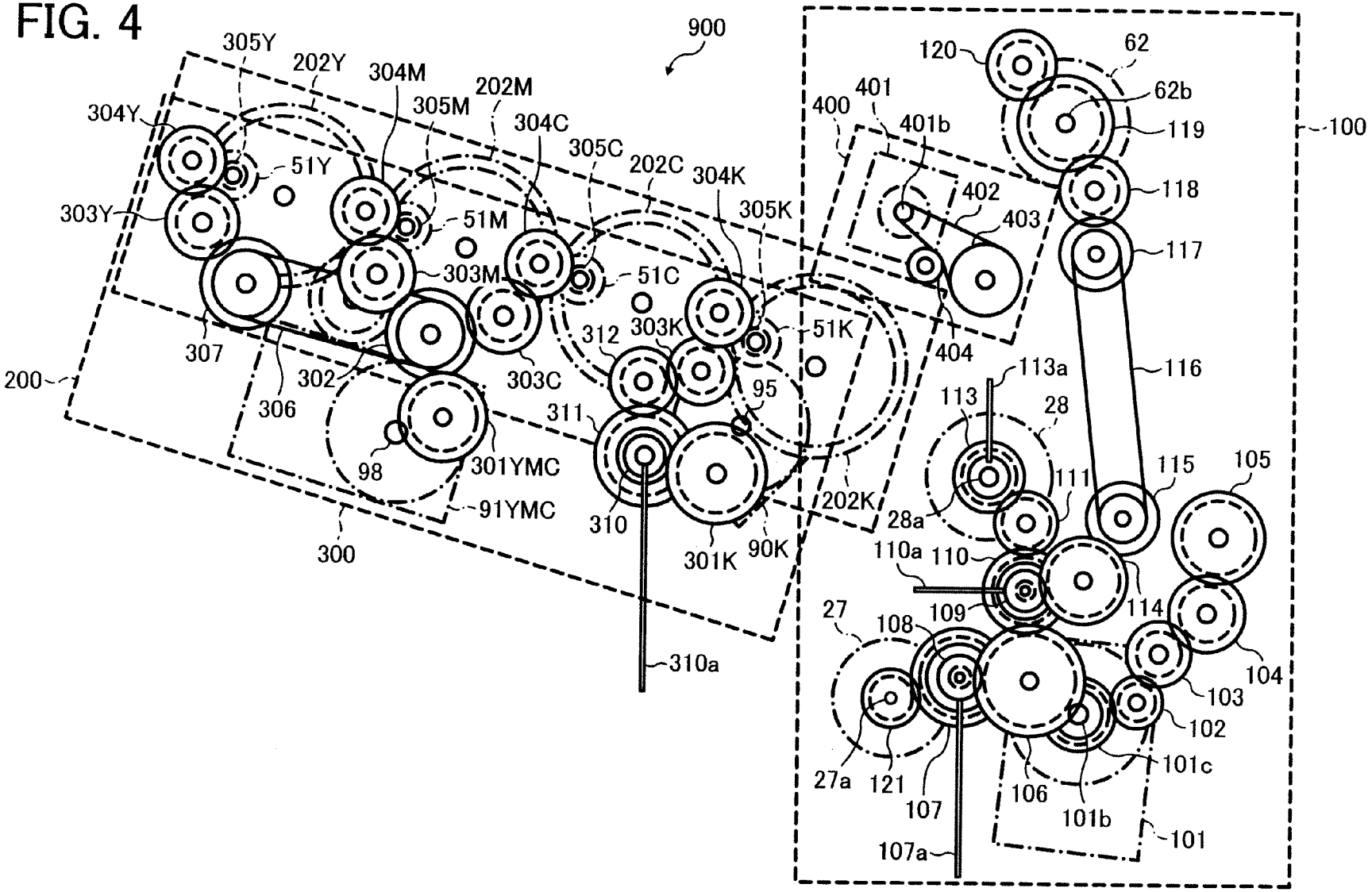
FIG. 4 is a schematic view of a driving device included in the image forming apparatus shown in FIG. 1.

FIG. 4 illustrates a part of a driving device of the image forming apparatus 900. As illustrated in FIG. 4, the image forming apparatus 900 further includes a photoconductor driver 200, a development roller driver 300, development rollers 51Y, 51M, 51C, and 51K, an intermediate transfer belt driver 400, and a feeding roller driver 100.

The photoconductor driver 200 drives the photoconductors 1Y, 1M, 1C, and 1K (depicted in FIG. 1). The development roller driver 300 drives the development rollers 51Y, 51M, 51C, and 51K. The development rollers 51Y, 51M, 51C, and 51K respectively carry the yellow, magenta, cyan, and black toners for developing the electrostatic latent images formed on the photoconductors 1Y, 1M, 1C, and 1K. The intermediate transfer belt driver 400 drives the intermediate transfer belt 8 (depicted in FIG. 1). The feeding roller driver 100 drives the feeding rollers 27 and 25*a* (depicted in FIG. 1), the registration roller pair 28 (depicted in FIG. 1), and the pressing roller 62 (depicted in FIG. 3).

Figure 5:
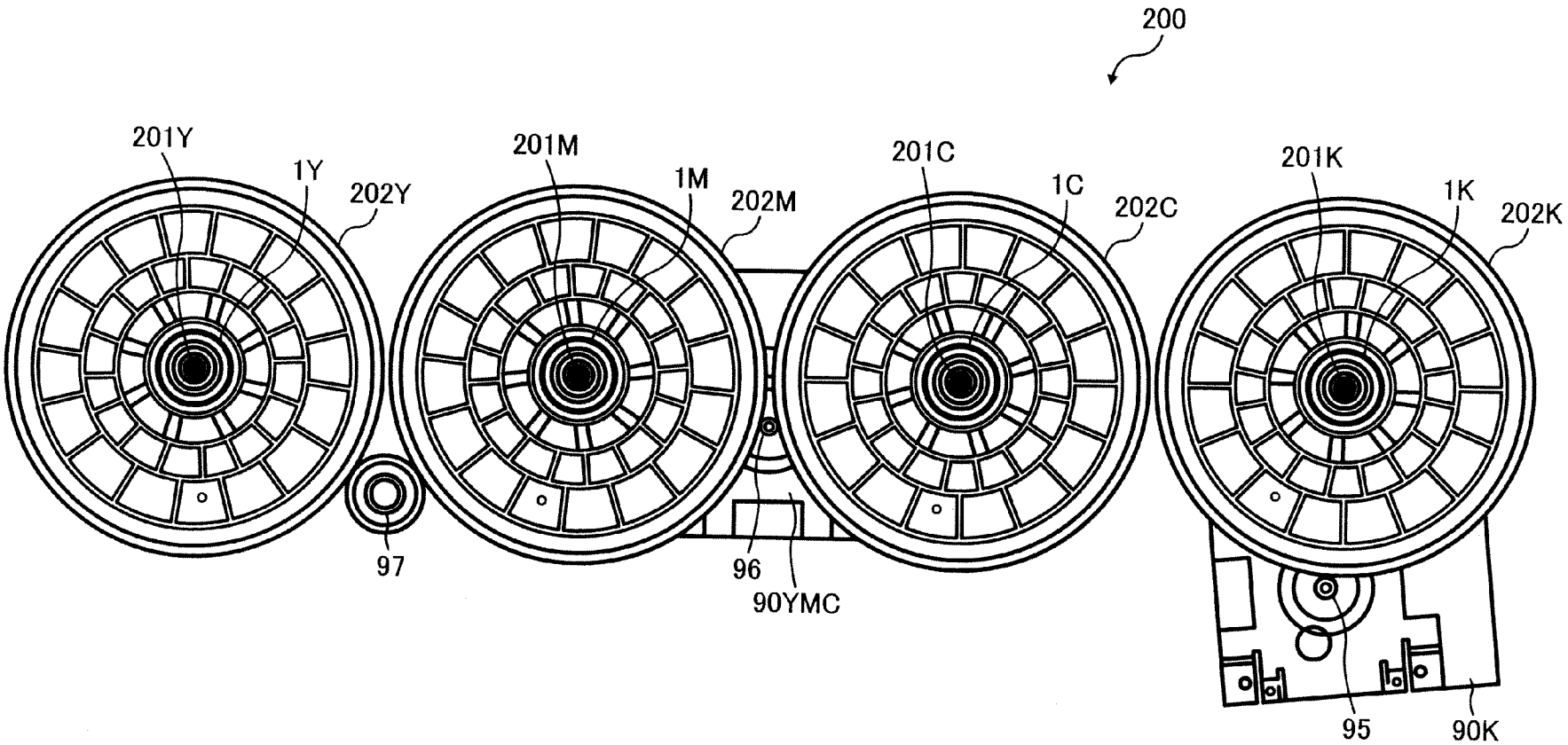
FIG. 5 is a schematic view of a photoconductor driver included in the driving device shown in FIG. 4.

FIG. 5 is a schematic view of the photoconductor driver 200. As illustrated in FIGS. 4 and 5, the photoconductor driver 200 includes rotating shafts 201Y, 201M, 201C, and 201K, photoconductor gears 202Y, 202M, 202C, and 202K, a motor gear 95, a photoconductor motor 90K, a motor gear 96, a photoconductor motor 90YMC, and an idler gear 97.

The rotating shafts 201Y, 201M, 201C, and 201K are respectively provided at axes of the photoconductors 1Y, 1M, 1C, and 1K. Bearings (not shown) support the rotating shafts 201Y, 201M, 201C, and 201K in a manner that the photoconductors 1Y, 1M, 1C, and 1K respectively rotate on the rotating shafts 201Y, 201M, 201C, and 201K. Each of the photoconductor gears 202Y, 202M, 202C, and 202K has a diameter greater than the diameter of each of the photoconductors 1Y, 1M, 1C, and 1K and is fixed to one end portion of each of the rotating shafts 201Y, 201M, 201C, and 201K in a longitudinal direction of each of the photoconductors 1Y, 1M, 1C, and 1K. The motor gear 95 is engaged with the photoconductor gear 202K. The motor gear 95 is fixed to a motor shaft (not shown) of the photoconductor motor 90K. The photoconductor motor 90K generates a driving force. With the above-described engagement, the driving force is transmitted from the photoconductor motor 90K to the photoconductor 1K via the motor gear 95, the photoconductor gear 202K, and the rotating shaft 201K so as to rotate the photoconductor 1K. The motor gear 96 is disposed between the photoconductor gear 202M and the photoconductor gear 202C and is engaged with the photoconductor gears 202M and 202C. The motor gear 96 is fixed to a motor shaft (not shown) of the photoconductor motor 90YMC. The photoconductor motor 90YMC generates a driving force. With the above-described engagement, the driving force is transmitted from the photoconductor motor 90YMC to the photoconductors 1M and 1C via the motor gear 96, the photoconductor gears 202M and 202C, and the rotating shafts 201M and 201C so as to rotate the photoconductors 1M and 1C. The idler gear 97 is disposed between the photoconductor gear 202Y and the photoconductor gear 202M and is engaged with the photoconductor gears 202Y and 202M. With the above-described engagement, the driving force is transmitted from the photoconductor motor 90YMC to the photoconductor 1Y via the motor gear 96, the photoconductor gear 202M, the idler gear 97, the photoconductor gear 202Y, and the rotating shaft 201Y.

Figure 6:
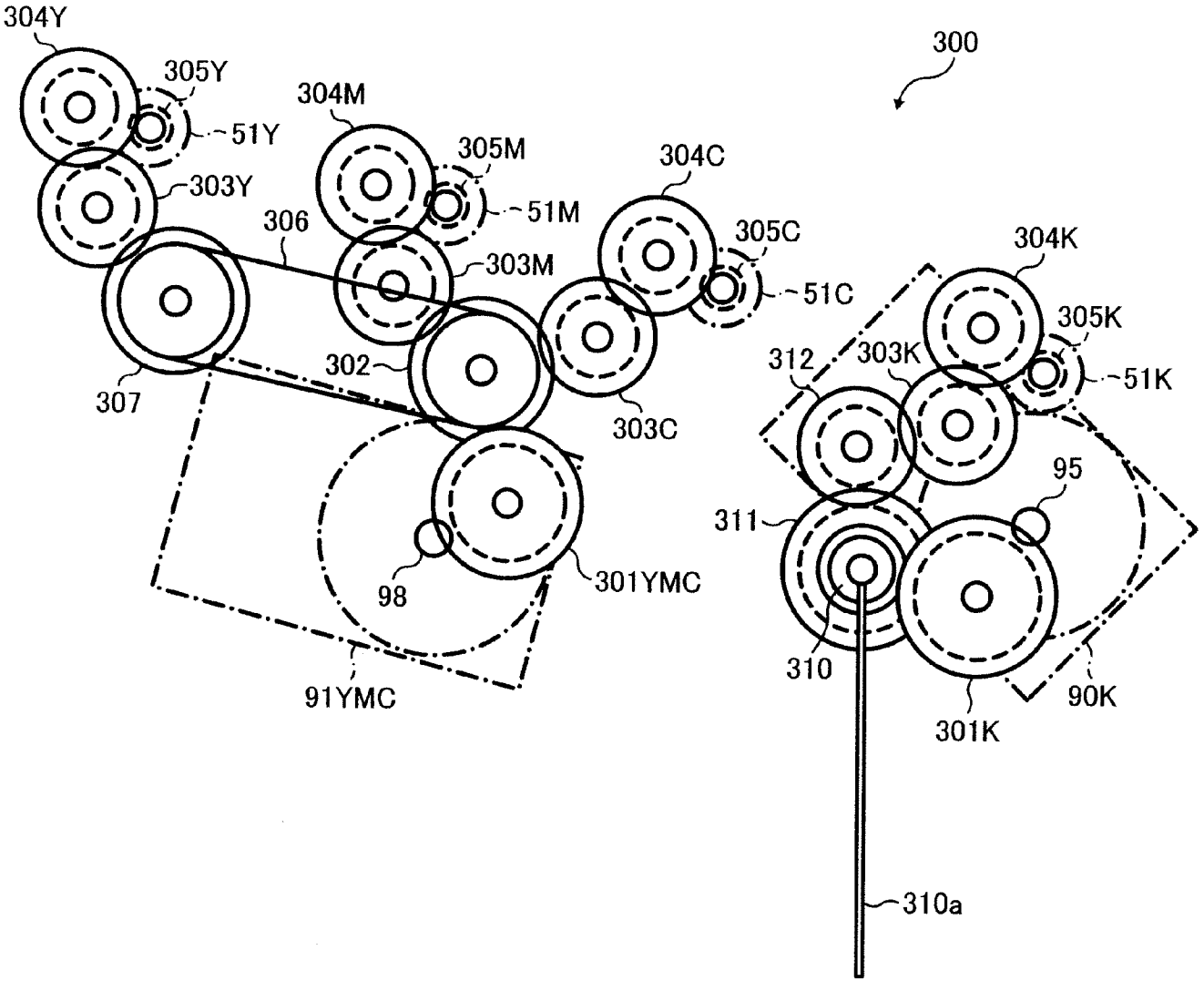
FIG. 6 is a schematic view of a development roller driver included in the driving device shown in FIG. 4.

FIG. 6 is a schematic view of the development roller driver 300. As illustrated in FIGS. 4 and 6, the development roller driver 300 includes development roller gears 305Y, 305M, 305C, and 305K, output gears 304Y, 304M, 304C, and 304K, first idler gears 303Y, 303M, 303C, and 303K, a second idler gear 312, a third idler gear 311, an electromagnetic clutch 310, a harness 310*a*, a reduction gear 301K, a first pulley 302, a second pulley 307, a timing belt 306, a reduction gear 301YMC, a motor gear 98, and a development roller motor 91YMC.

Each of the development roller gears 305Y, 305M, 305C, and 305K is fixed to one end portion of a rotating shaft (not shown) of each of the development rollers 51Y, 51M, 51C, and 51K in a longitudinal direction of the development rollers 51Y, 51M, 51C, and 51K. The development roller gears 305Y, 305M, 305C, and 305K are respectively engaged with the output gears 304Y, 304M, 304C, and 304K. The output gears 304Y, 304M, 304C, and 304K are respectively engaged with the first idler gears 303Y, 303M, 303C, and 303K.

The first idler gear 303K is engaged with the second idler gear 312. The second idler gear 312 is engaged with the third idler gear 311. The third idler gear 311 includes a rotating shaft (not shown) on which the electromagnetic clutch 310 is disposed. The electromagnetic clutch 310 is connected to the harness 310*a*. A power source (not shown) supplies power to the electromagnetic clutch 310 via the harness 310*a*. The electromagnetic clutch 310 is engaged with the reduction gear 301K. The reduction gear 301K is engaged with the motor gear 95 which is fixed to the motor shaft of the photoconductor motor 90K. The reduction gear 301K reduces a driving force generated by the photoconductor motor 90K. The reduced driving force is transmitted to the development roller 51K via the electromagnetic clutch 310, the third idler gear 311, the second idler gear 312, the first idler gear 303K, the output gear 304K, and the development roller gear 305K. The photoconductor motor 90K drives both the photoconductor 1K and the development roller 51K. Therefore, to drive the photoconductor 1K but not to drive the development roller 51K, the electromagnetic clutch 310 is disengaged with the rotating shaft of the third idler gear 311 so that the driving force generated by the photoconductor motor 90K is not transmitted to the third idler gear 311.

The first idler gears 303C and 303M are engaged with the first pulley 302. The first idler gear 303Y is engaged with the second pulley 307. The timing belt 306 is looped over the first pulley 302 and the second pulley 307. The first pulley 302 is engaged with the reduction gear 301YMC. The reduction gear 301YMC is engaged with the motor gear 98. The motor gear 98 is fixed to a motor shaft of the development roller motor 91YMC. The development roller motor 91YMC generates a driving force.

The reduction gear 301YMC reduces the driving force generated by the development roller motor 91YMC. The reduced driving force is transmitted to the first pulley 302. The reduced driving force is further transmitted to the development roller 51C via the first idler gear 303C, the output gear 304C, and the development roller gear 305C. The reduced driving force is also transmitted to the development roller 51M via the first idler gear 303M, the output gear 304M, and the development roller gear 305M. Further, the reduced driving force is also transmitted to the development roller 51Y via the timing belt 306, the second pulley 307, the first idler gear 303Y, the output gear 304Y, and the development roller gear 305Y.

The photoconductor 1K and the development roller 51K are rotatably driven by the photoconductor motor 90K which is provided to drive the photoconductor 1K and the development roller 51 but not to drive the photoconductors 1Y, 1M, and 1C and the development rollers 51Y, 51M, and 51C. The photoconductor 1K and the development roller 51K are driven by the exclusive driver (i.e., the photoconductor motor 90K), because the image forming apparatus 900 forms monochrome images more frequently than color images. When the image forming apparatus 900 forms a monochrome image, the photoconductor 1K and the development roller 51K are driven but the photoconductors 1Y, 1M, and 1C and the development rollers 51Y, 51M, and 51C are not driven. Thus, the photoconductors 1Y, 1M, and 1C, the development rollers 51Y, 51M, and 51C, and the gears and motors used for driving the photoconductors 1Y, 1M, and 1C and the development rollers 51Y, 51M, and 51C cannot easily wear and energy can be saved. When the photoconductor 1K is driven and the photoconductors 1Y, 1M, and 1C are not driven so as to form a monochrome image, the intermediate transfer belt 8 (depicted in FIG. 1) contacts the photoconductor 1K and does not contact the photoconductors 1Y, 1M, and 1C.

As illustrated in FIG. 4, the intermediate transfer belt driver 400 includes an intermediate transfer belt motor 401, a motor shaft 401*b*, a timing pulley 403, a timing belt 402, and a tension pulley 404.

The intermediate transfer belt motor 401 rotatably drives the intermediate transfer belt 8 (depicted in FIG. 1). The motor shaft 401*b* is disposed on the intermediate transfer belt motor 401. The timing pulley 403 is fixed to a rotating shaft (not shown) of the second transfer backup roller 12 (depicted in FIG. 1). The timing belt 402 is looped over the motor shaft 401*b* and the timing pulley 403. The tension pulley 404 contacts an outer circumferential surface of the timing belt 402 and applies tension to the timing belt 402. The intermediate transfer belt motor 401 includes a stepping motor. A driving force generated by the intermediate transfer belt motor 401 is transmitted to the second transfer backup roller 12 via the motor shaft 401*b*, the timing belt 402 and the timing pulley 403. Thus, the second transfer backup roller 12 serves as a driving roller for rotatably driving the intermediate transfer belt 8. An encoder (not shown) is attached to the second transfer backup roller 12 and detects the linear speed of the rotating intermediate transfer belt 8. Specifically, the encoder detects the linear speed of the rotating intermediate transfer belt 8, which changes due to changes in temperature, humidity, and load applied to the intermediate transfer belt 8. The encoder feeds back the detected linear speed to the intermediate transfer belt motor 401 to control the intermediate transfer belt motor 401. Thus, the linear speed of the intermediate transfer belt 8 can be maintained at a predetermined speed.

As illustrated in FIG. 4, the feeding roller driver 100 includes a feeding roller motor 101, a clutch 101*c*, a motor gear 101*b*, a gear 102, an idler gear 103, an output gear 104, a bypass tray gear 105, a reduction gear 106, an idler gear 108, a clutch 107, a harness 107*a*, a feeding roller gear 121, a clutch 110, an idler gear 111, a clutch 113, a harness 113*a*, a first idler gear 109, a harness 110*a*, a second idler gear 114, a first pulley 115, a second pulley 117, a timing belt 116, an output gear 118, a fixing belt gear 119, and an output gear 120. The feeding roller 27 includes a rotating shaft 27*a*. The registration roller pair 28 includes a rotating shaft 28*a*. The pressing roller 62 includes a rotating shaft 62*b*.

The feeding roller motor 101 drives the feeding roller 25*a* (depicted in FIG. 1), the feeding roller 27, one of the two rollers forming the registration roller pair 28 (i.e., a driving roller), and the pressing roller 62. The driving roller of the registration roller pair 28 drives the other roller (i.e., a driven roller). The clutch 101*c* and the motor gear 101*b* are fixed to a motor shaft (not shown) of the feeding roller motor 101. The clutch 101*c* is engaged with the gear 102. The gear 102 is engaged with the idler gear 103. The idler gear 103 is engaged with the output gear 104. The output gear 104 is engaged with the bypass tray gear 105. The bypass tray gear 105 is fixed to a rotating shaft (not shown) of the feeding roller 25*a*. When a toner image is to be formed on a sheet P loaded on the bypass tray 25 (depicted in FIG. 1), the clutch 101*c* is engaged to transmit a driving force generated by the feeding roller motor 101 to the gear 102. The driving force is further transmitted to the feeding roller 25*a* via the idler gear 103, the output gear 104, and the bypass tray gear 105. When a toner image is not to be formed on a sheet P loaded on the bypass tray 25, the clutch 101*c* is disengaged not to transmit a driving force generated by the feeding roller motor 101 to the feeding roller 25*a*.

The motor gear 101*b* is engaged with the reduction gear 106. The reduction gear 106 is engaged with the idler gear 108. The clutch 107 is an electromagnetic clutch and is disposed on a rotating shaft (not shown) of the idler gear 108. The clutch 107 is connected to the harness 107*a*. Power is supplied to the clutch 107 via the harness 107*a*. The clutch 107 is engaged with the feeding roller gear 121 fixed to the rotating shaft 27*a* of the feeding roller 27. Thus, when a toner image is to be formed on a sheet P loaded on the paper tray 26 (depicted in FIG. 1), the clutch 107 is engaged by power supplied via the harness 107*a*. As a result, the reduction gear 106 reduces a driving force generated by the feeding roller motor 101. The reduced driving force is transmitted to the feeding roller 27 via the idler gear 108, the clutch 107, the feeding roller gear 121, and the rotating shaft 27*a*. Thus, the feeding roller 27 rotates to feed the sheet P loaded on the paper tray 26 toward the registration roller pair 28.

The reduction gear 106 is engaged with the clutch 110 (e.g., an electromagnetic clutch). The clutch 110 is engaged with the idler gear 111. The idler gear 111 is engaged with the clutch 113 disposed on the rotating shaft 28*a* of the driving roller of the registration roller pair 28. Power is supplied to the clutch 113 via the harness 113*a*. Thus, to rotate the driving roller of the registration roller pair 28, the clutch 113 is engaged by power supplied via the harness 113*a*. As a result, the reduction gear 106 reduces a driving force generated by the feeding roller motor 101. The reduced driving force is transmitted to the driving roller of the registration roller pair 28 via the clutch 110, the idler gear 111, the clutch 113, and the rotating shaft 28*a*.

The first idler gear 109 is fixed to a rotating shaft (not shown) on which the clutch 110 is disposed. The harness 110*a* is connected to the clutch 110 and supplies power to the clutch 110. The first idler gear 109 is engaged with the second idler gear 114. The second idler gear 114 is engaged with the first pulley 115. The second pulley 117 is disposed above the first pulley 115. The timing belt 116 is looped over the first pulley 115 and the second pulley 117. The second pulley 117 is engaged with the output gear 118. The output gear 118 is engaged with the fixing belt gear 119. The fixing belt gear 119 is fixed to the rotating shaft 62*b* of the pressing roller 62 which rotatably drives the fixing belt 61 (depicted in FIG. 3).

To rotate the fixing belt 61, the harness 110*a* supplies power to the clutch 110 to drive the clutch 110. A gear (not shown) of the clutch 110, which is idled, starts rotating together with the rotating shaft to which the first idler gear 109 is fixed. A driving force generated by the feeding roller motor 101 and reduced by the reduction gear 106 is transmitted to the first idler gear 109. The driving force is further transmitted to the pressing roller 62 via the second idler gear 114, the first pulley 115, the timing belt 116, the second pulley 117, the output gear 118, the fixing belt gear 119, and the rotating shaft 62*b*. The driving force transmitted to the pressing roller 62 rotates the pressing roller 62 and the rotating pressing roller 62 rotates the fixing belt 61.

The fixing belt gear 119 is engaged with the output gear 120 which is fixed to a rotating shaft (not shown) of the output roller pair 29 (depicted in FIG. 1). Thus, the driving force generated by the feeding roller motor 101 is transmitted to the output roller pair 29.

In the image forming apparatus 900 according to this non-limiting exemplary embodiment, the length of the conveyance path 71 (depicted in FIG. 1) originating at the registration nip and ending at the fixing nip in the sheet conveyance direction is shorter than the length in the sheet conveyance direction of a sheet P having a maximum size which can be handled by the image forming apparatus 900, so that the image forming apparatus 900 is compact in size. However, in the image forming apparatus 900 including the short conveyance path 71, the following problems may occur when a linear speed Vt (i.e., a rotating speed of the pressing roller 62 depicted in FIG. 3) is substantially faster than a linear speed Vc (i.e., a rotating speed of the intermediate transfer belt 8 depicted in FIG. 1). For example, when a toner image is continuously formed on a plurality of sheets P, a defective image having a black line (i.e., shock jitter) formed in a main scanning direction may be formed on the second or succeeding sheet P. Specifically, a sheet P is conveyed to the fixing nip while the sheet P is guided by a guide (not shown) disposed on a downstream side from the second transfer nip and on an upstream side from the fixing nip relative to the sheet conveyance direction. When the foremost head of the sheet P enters the fixing nip, the sheet P is bent. When the linear speed Vt of the pressing roller 62 is substantially faster than the linear speed Vc of the intermediate transfer belt 8, the sheet P is conveyed at the fixing nip at the speed faster than the speed at which the sheet P is conveyed at the second transfer nip. Namely, the sheet P is fed at the fixing nip for the length greater than the length for which the sheet P is fed at the second transfer nip in the sheet conveyance direction. As a result, the sheet P is not bent between the second transfer nip and the fixing nip. Thus, before the tail of the sheet P passes the second transfer nip, the sheet P is stretched between the second transfer nip and the fixing nip, and thereby the sheet P is conveyed at the second transfer nip at the same speed as the fixing nip. When the sheet P is conveyed at the second transfer nip at the linear speed Vt of the pressing roller 62, the intermediate transfer belt 8 is not rotated by the driving force of the intermediate transfer belt motor 401 (depicted in FIG. 4) but is rotated at the linear speed Vt of the pressing roller 62 by the sheet P conveyed at the linear speed Vt of the pressing roller 62. When the tail of the sheet P passes the second transfer nip, the intermediate transfer belt 8 is rotated by the driving force of the intermediate transfer belt motor 401. However, the driving force is not immediately transmitted from the intermediate transfer belt motor 401 to the intermediate transfer belt 8 due to backlash of the intermediate transfer belt driver 400 (depicted in FIG. 4), and the intermediate transfer belt 8 temporarily stops rotating. When a toner image is transferred from any of the photoconductors 1Y, 1M, 1C, and 1K (depicted in FIG. 1) onto the intermediate transfer belt 8 while the intermediate transfer belt 8 temporarily stops, shock jitter may be formed on the transferred toner image.

When a toner image is formed on a thick sheet P, shock jitter may be formed on the tail of the sheet P when a linear speed Vr (i.e., a rotating speed of the registration roller pair 28 depicted in FIG. 1) is faster than the linear speed Vt of the pressing roller 62. When the linear speed Vr of the registration roller pair 28 is faster than the linear speed Vt of the pressing roller 62, the registration roller pair 28 feeds the sheet P for the length greater than the length for which the sheet P is fed at the fixing nip in the sheet conveyance direction. As a result, the sheet P is excessively bent between the registration nip and the fixing nip. The distance between the second transfer nip and the fixing nip is greater than the distance between the registration nip and the second transfer nip. Therefore, the sheet P is bent between the second transfer nip and the fixing nip more easily than between the registration nip and the second transfer nip. Namely, the sheet P is bent between the second transfer nip and the fixing nip more excessively than between the registration nip and the second transfer nip. When the tail of the sheet P passes the registration nip, the tail edge of the sheet P is not pushed and an elastic force of the bent sheet P for stretching causes the bent sheet P to stretch.

The elastic force is greater between the second transfer nip and the fixing nip than between the registration nip and the second transfer nip, because the sheet P is bent between the second transfer nip and the fixing nip more excessively than between the registration nip and the second transfer nip. At the fixing nip, the pressing roller 62 contacts the fixing belt 61 (depicted in FIG. 3) while applying a substantial pressure to the fixing belt 61. Therefore, the elastic force of the bent sheet P for stretching does not cause the sheet P to slip at the fixing nip. At the second transfer nip, however, the second transfer bias roller 19 (depicted in FIG. 1) applies a pressure smaller than the pressure applied by the pressing roller 62 to the intermediate transfer belt 8. Also, the intermediate transfer belt 8 has a small friction coefficient. Thus, the elastic force of the bent sheet P for stretching causes the bent sheet P to slip at the second transfer nip in a direction opposite to the sheet conveyance direction. As a result, shock jitter may be formed on the tail of the sheet P.

A thin sheet P has a small elastic force for stretching when it is bent. Thus, even when the thin sheet P is excessively bent, jitter may not be formed easily.

When the linear speed Vt of the pressing roller 62 is slower than the linear speed Vc of the intermediate transfer belt 8, the sheet P is substantially bent between the second transfer nip and the fixing nip. As a result, shock jitter may be formed on the tail of the sheet P due to the elastic force of the bent sheet P for stretching, as described above. When a toner image is formed on a thick sheet P, shock jitter may be formed on the tail of the sheet P, as described above, when the linear speed Vr of the registration roller pair 28 is faster than the linear speed Vc of the intermediate transfer belt 8. Therefore, when a toner image is formed on a thick sheet P, the relationship among the linear speed Vr of the registration roller pair 28, the linear speed Vc of the intermediate transfer belt 8, and the linear speed Vt of the pressing roller 62 satisfies the both conditions shown below.

| | |
|---|---|
| $Vr<Vc<Vt$ | Condition 1 |
| Vc nearly equaling to Vt | Condition 2 |

When the linear speed Vr of the registration roller pair 28 is slower than the linear speed Vc of the intermediate transfer belt 8 and the linear speed Vt of the pressing roller 62, the sheet P is not bent between the registration nip and the second transfer nip and between the second transfer nip and the fixing nip. As a result, shock jitter may not be formed on the tail of the sheet P. When the linear speed Vt of the pressing roller 62 is faster than the linear speed Vc of the intermediate transfer belt 8, the sheet P is not excessively bent between the second transfer nip and the fixing nip. As a result, shock jitter may not be formed on the tail of the sheet P. When the linear speed Vt of the pressing roller 62 is slightly different from the linear speed Vc of the intermediate transfer belt 8, the sheet P is not stretched between the second transfer nip and the fixing nip before the tail of the sheet P passes the second transfer nip. Thus, the sheet P is not conveyed at the second transfer nip at the same speed as the linear speed Vt of the pressing roller 62. As a result, shock jitter may not be formed on the second or succeeding sheet P.

Figure 7:
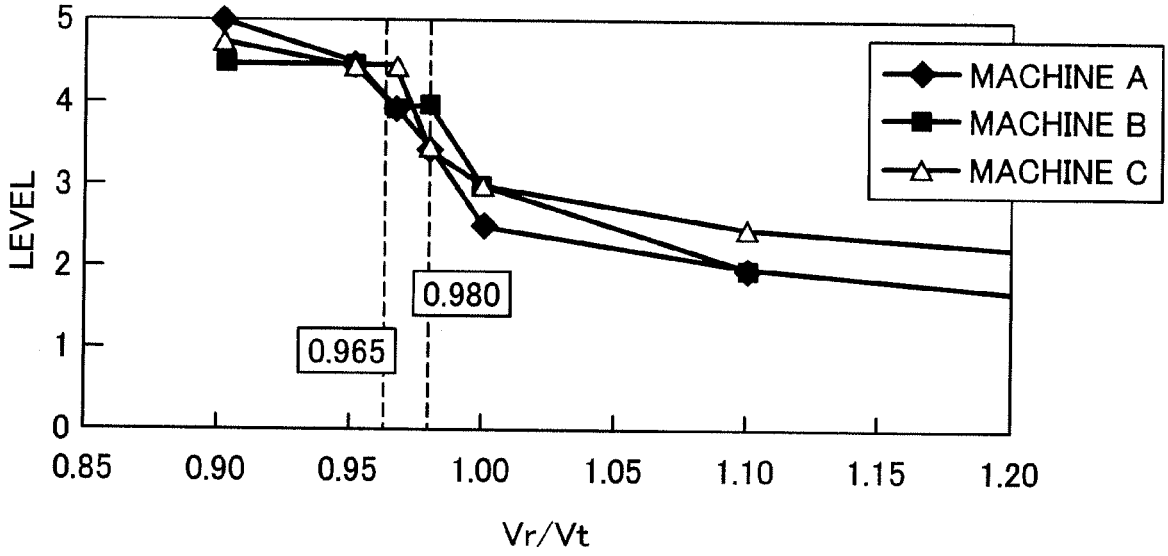
FIG. 7 is a graph illustrating a relationship between a linear speed ratio of a linear speed of a registration roller pair included in the image forming apparatus shown in FIG. 1 to a linear speed of a pressing roller included in the fixing unit shown in FIG. 3 and a level of shock jitter formed on a tail of a thick sheet.

FIG. 7 is a graph illustrating the relationship between a linear speed ratio Vr/Vt of the linear speed Vr of the registration roller pair 28 to the linear speed Vt of the pressing roller 62 and the level of shock jitter formed on the tail of a sheet P. The relationship was measured with three test machines (i.e., machines A, B, and C) by using sheets having the paper thickness of about 180 kilograms which were sensitive to shock jitter formed on the tail of the sheet P. The level of shock jitter was ranked with five levels by visual inspection. Level 5 indicates that shock jitter is not found. Level 4 indicates that shock jitter is slightly found and it is recognized as shock jitter with difficulty. Level 3 indicates that shock jitter is found with difficulty. Level 2 indicates that shock jitter is found relatively easily. Level 1 indicates that shock jitter is quickly found. Levels 3.5 or higher are acceptable levels. The measurement was performed with the fixing unit 20 (depicted in FIG. 3) sufficiently heated and the pressing roller 62 thermally expanded up to the maximum level, because the linear speed Vt of the pressing roller 62, when the pressing roller 62 is thermally expanded up to the maximum level, increases by about 0.5 percent compared to when the pressing roller 62 is not thermally expanded during a warm-up, for example.

As illustrated in FIG. 7, when the linear speed ratio Vr/Vt is about 0.98 or smaller, the levels of shock jitter of the machines A, B, and C are 3.5 or higher and a proper toner image can be formed. When the linear speed ratio Vr/Vt is about 0.965 or smaller, the levels of shock jitter of the machines A, B, and C are 4 or higher and shock jitter is hardly found.

Figure 8:
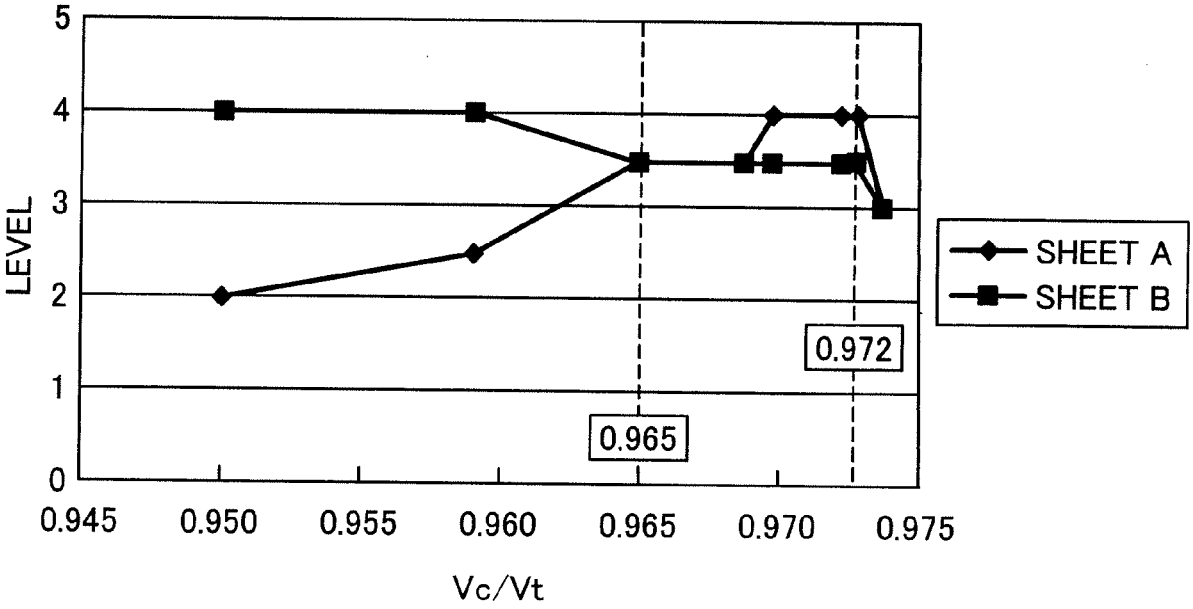
FIG. 8 is a graph illustrating a relationship between a linear speed ratio of a linear speed of an intermediate transfer belt included in the image forming apparatus shown in FIG. 1 to a linear speed of a pressing roller included in the fixing unit shown in FIG. 3 and a level of shock jitter formed on a second or succeeding, thick sheet.

FIG. 8 is a graph illustrating the relationship between a linear speed ratio Vc/Vt of the linear speed Vc of the intermediate transfer belt 8 to the linear speed Vt of the pressing roller 62 and the level of shock jitter formed on the second or succeeding, thick sheet P. The relationship was measured by using a sheet A having a basis weight of greater than about 90.2 g/m$^2$ and not greater than about 104.7 g/m$^2$ and a sheet B having a basis weight of greater than about 104.7 g/m$^2$ and not greater than about 209.4 g/m$^2$.

As illustrated in FIG. 8, when the linear speed ratio Vc/Vt is about 0.965 or smaller, the level of shock jitter of the sheet A is 3.5 or lower and shock jitter is noticeably formed on the second or succeeding sheet P. When the linear speed ratio Vc/Vt is greater than about 0.972, the level of shock jitter of the sheets A and B is the level 3, that is, an unacceptable level. Therefore, the linear speed ratio Vc/Vt is preferably greater than about 0.965 and not greater than about 0.972.

When the linear speed Vr of the registration roller pair 28 is slower than the linear speed Vc of the intermediate transfer belt 8, shock jitter caused by the bent sheet P can be suppressed between the registration nip and the second transfer nip. Therefore, the linear speed Vr of the registration roller pair 28 may be, by a maximum driving tolerance, slower than the linear speed Vc of the intermediate transfer belt 8. According to this non-limiting exemplary embodiment, when the linear speed Vr of the registration roller pair 28 is about 0.4 percent slower than the linear speed Vc of the intermediate transfer belt 8, the linear speed Vr of the registration roller pair 28 can be slower than the linear speed Vc of the intermediate transfer belt 8 even when the linear speed Vc of the intermediate transfer belt 8 slightly decreases and the linear speed Vr of the registration roller pair 28 slightly increases. Namely, the linear speed ratio Vr/Vc can be about 0.996 or smaller. When the linear speed Vr of the registration roller pair 28 is excessively slower than the linear speed Vc of the intermediate transfer belt 8, the sheet P may be conveyed at the second transfer nip at the linear speed Vr of the registration roller pair 28 instead of the linear speed Vc of the intermediate transfer belt 8. When the sheet P is conveyed at the second transfer nip at the linear speed Vr of the registration roller pair 28, a shrunk toner image may be formed on the sheet P when a toner image is transferred from the intermediate transfer belt 8 onto the sheet P. Otherwise, shock jitter may be formed on the sheet P due to backlash of the intermediate transfer belt driver 400 which occurs when the tail of the sheet P passes the registration roller pair 28. Therefore, the linear speed ratio Vr/Vc is preferably suppressed to about 0.996.

Namely, the linear speed ratio Vr/Vt is preferably about 0.968 or smaller so that the linear speed ratio Vc/Vt is about 0.972 or smaller and the linear speed ratio Vr/Vc is about 0.996 or smaller.

To form a toner image on a thick sheet P having a great elastic force for stretching when it is bent, the linear speed Vr of the registration roller pair 28, the linear speed Vc of the intermediate transfer belt 8, and the linear speed Vt of the pressing roller 62 are set by considering bending of the sheet P which is caused between the registration nip and the second transfer nip. To form a toner image on a thin sheet P having a small elastic force for stretching when it is bent, the relationship among the linear speed Vr of the registration roller pair 28, the linear speed Vc of the intermediate transfer belt 8, and the linear speed Vt of the pressing roller 62 is preferably different from the relationship for the thick sheet P. The following describes the reason.

When the linear speed Vr of the registration roller pair 28 is slower than the linear speed Vc of the intermediate transfer belt 8, a sheet P is stretched between the registration nip and the second transfer nip. Thus, the sheet P may be conveyed at the second transfer nip at the linear speed Vr of the registration roller pair 28 instead of the linear speed Vc of the intermediate transfer belt 8. When the sheet P is conveyed at the second transfer nip at the linear speed Vr of the registration roller pair 28, a shrunk toner image may be formed on the sheet P when a toner image is transferred from the intermediate transfer belt 8 onto the sheet P. Shock jitter, which may be formed on the tail of a thick sheet P, may not be formed on a sheet P having a small elastic force for stretching when it is bent, unless the sheet P is substantially bent between the registration nip and the second transfer nip. Therefore, to form a toner image on a sheet P having a small elastic force for stretching when it is bent, the linear speed Vr of the registration roller pair 28 is preferably faster than the linear speed Vc of the intermediate transfer belt 8.

When the linear speed Vr of the registration roller pair 28 is faster than the linear speed Vc of the intermediate transfer belt 8, a shrunk toner image may not be formed on a sheet P when a toner image is transferred from the intermediate transfer belt 8 onto the sheet P. Therefore, the linear speed Vr of the registration roller pair 28 may be, by a maximum driving tolerance, faster than the linear speed Vc of the intermediate transfer belt 8. According to this non-limiting exemplary embodiment, when the linear speed Vr of the registration roller pair 28 is about 0.4 percent faster the linear speed Vc of the intermediate transfer belt 8, the linear speed Vr of the registration roller pair 28 can be faster than the linear speed Vc of the intermediate transfer belt 8 even when the linear speed Vc of the intermediate transfer belt 8 slightly increases and the linear speed Vr of the registration roller pair 28 slightly decreases. Namely, the linear speed ratio Vr/Vc can be about 1.004 or greater. When the linear speed Vr of the registration roller pair 28 is excessively faster than the linear speed Vc of the intermediate transfer belt 8, the sheet P may be substantially bent between the registration nip and the second transfer nip. Thus, even when a thin sheet P has a small elastic force for stretching when it is bent, the elastic force increases when the sheet P is substantially bent, and the increased elastic force causes the sheet P to stretch. As a result, shock jitter may be formed on the tail of the sheet P. Therefore, the linear speed ratio Vr/Vc is preferably suppressed to about 1.004.

In the image forming apparatus 900 according to this non-limiting exemplary embodiment, the pressing roller 62 and the registration roller pair 28 are driven by a common driver, that is, the feeding roller motor 101 (depicted in FIG. 4). Therefore, the relationship between the linear speed Vr of the registration roller pair 28 and the linear speed Vt of the pressing roller 62 cannot be changed in accordance with paper type such as thick paper and thin paper (e.g., plain paper). To address this problem, the gears and the pitch of the gears are adjusted to cause the linear speed Vt of the pressing roller 62 to be faster than the linear speed Vr of the registration roller pair 28. To form a toner image on a thick sheet P, the number of rotations of the feeding roller motor 101 is controlled to satisfy the above-described conditions 1 and 2. To form a toner image on a thin sheet P having a small elastic force for stretching when it is bent, the number of rotations of the feeding roller motor 101 is increased compared to the number of rotations of the feeding roller motor 101 when forming a toner image on a thick sheet P, so as to cause the linear speed Vr of the registration roller pair 28 to be faster than the linear speed Vc of the intermediate transfer belt 8.

As described above, when the common driver (i.e., the feeding roller motor 101) drives both the registration roller pair 28 and the pressing roller 62, the relationship between the linear speed Vr of the registration roller pair 28 and the linear speed Vt of the pressing roller 62 cannot be changed in accordance with paper type. Therefore, to form a toner image on a sheet P having a small elastic force for stretching when it is bent (e.g., a plain paper sheet), the relationship among the linear speed Vr of the registration roller pair 28, the linear speed Vc of the intermediate transfer belt 8, and the linear speed Vt of the pressing roller 62 satisfies the following condition.

$$Vc<Vr<Vt \qquad \text{Condition 3}$$

To form a toner image on a thick sheet P, when the linear speed ratio Vr/Vt is set to be about 0.968 or smaller, the conditions 1 and 2 can be satisfied and thereby a proper toner image without shock jitter can be formed on the thick sheet P. However, when the linear speed ratio Vr/Vt is too small when forming a toner image on a plain paper sheet P, the linear speed Vt of the pressing roller 62 may be excessively faster than the linear speed Vc of the intermediate transfer belt 8. To form a toner image on a plain paper sheet P, the linear speed ratio Vc/Vt for a plain paper sheet P is smaller than the linear speed ratio Vc/Vt for a thick sheet P. However, when the linear speed Vt of the pressing roller 62 is excessively faster than the linear speed Vc of the intermediate transfer belt 8, shock jitter may be formed on the second or succeeding sheet P.

Figure 9:
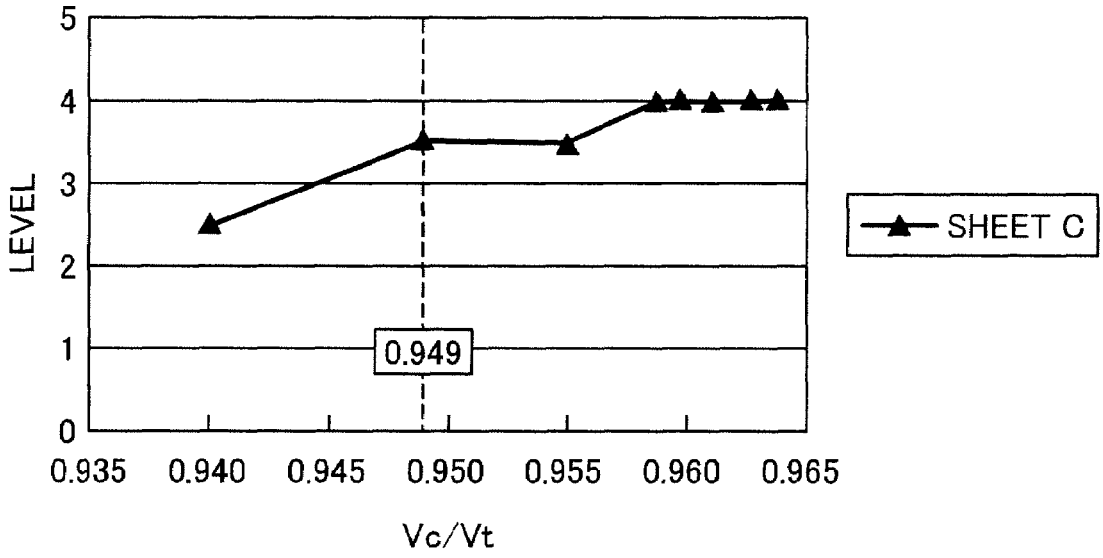
FIG. 9 is a graph illustrating a relationship between a linear speed ratio of a linear speed of an intermediate transfer belt included in the image forming apparatus shown in FIG. 1 to a linear speed of a pressing roller included in the fixing unit shown in FIG. 3 and a level of shock jitter formed on a second or succeeding, plain paper sheet.

FIG. 9 is a graph illustrating the relationship between a linear speed ratio Vc/Vt of the linear speed Vc of the intermediate transfer belt 8 to the linear speed Vt of the pressing roller 62 and the level of shock jitter formed on the second or succeeding, plain paper sheet P. The relationship was measured by using a sheet C having a basis weight of about 90.2 $g/m^2$ or smaller. As illustrated in FIG. 9, when the linear speed ratio Vc/Vt is about 0.949 or smaller, the level of shock jitter is 3.5 or lower and shock jitter is noticeably formed on the second or succeeding sheet. Thus, a proper image is not formed.

The linear speed ratio Vr/Vt needs to be about 0.953 or greater so that the linear speed ratio Vc/Vt is about 0.949 or greater and the linear speed ratio Vr/Vc is about 1.004 or greater.

In the image forming apparatus 900 in which the relationship between the linear speed Vr of the registration roller pair 28 and the linear speed Vt of the pressing roller 62 cannot be changed in accordance with paper type because the common driver drives both the registration roller pair 28 and the pressing roller 62, the linear speed ratio Vr/Vt is preferably in a range of from about 0.953 to about 0.968.

Figure 10:
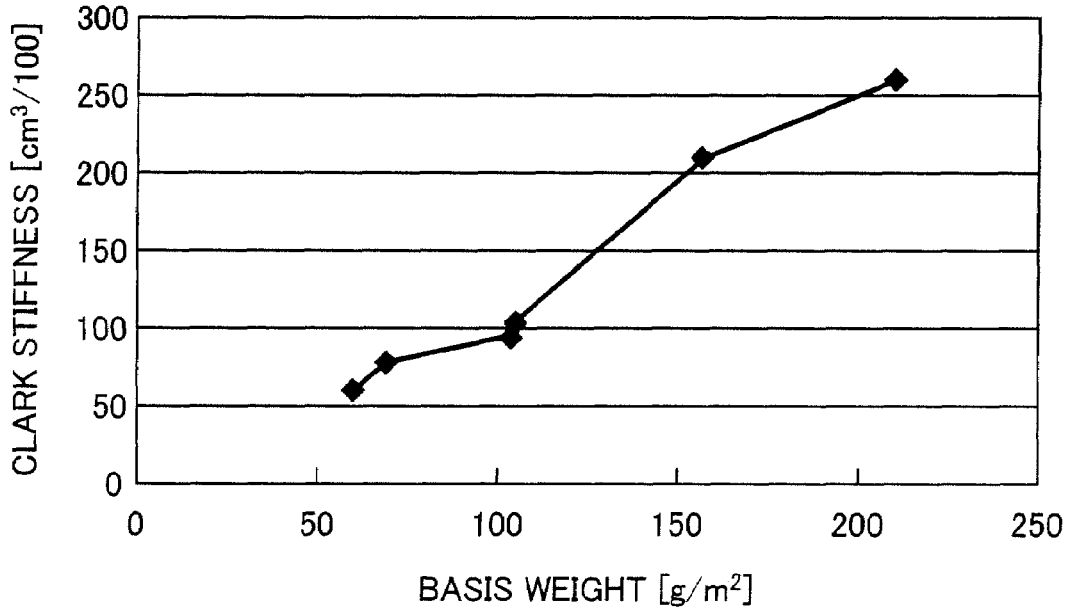
FIG. 10 is a graph illustrating a relationship between a Clark stiffness and a basis weight of a sheet.

FIG. 10 is a graph illustrating the relationship between the Clark stiffness and the basis weight of a sheet P. The Clark stiffness indicates a resistance of a bent sheet P to stretch. The greater the Clark stiffness is, the greater stiffness and the greater force for stretching a bent sheet P has. As illustrated in FIG. 10, when the basis weight exceeds about 100 g/m$^2$, the Clark stiffness sharply increases. This means that the stiffness of the sheet P sharply increases when the sheet P has a basis weight of greater than about 100 g/m$^2$. Therefore, the basis weight of about 90.2 g/m$^2$ is defined as a threshold by providing an adequate allowance. When a sheet P has a basis weight of greater than about 90.2 g/m$^2$, the sheet P is recognized as a thick sheet and the number of rotations of the feeding roller motor 101 is controlled to satisfy the above-described conditions 1 and 2. When a sheet P has a basis weight of about 90.2 g/m$^2$ or smaller, the sheet P is recognized as a plain paper sheet and the number of rotations of the feeding roller motor 101 is controlled to satisfy the above-described condition 3.

In the image forming apparatus 900 according to this non-limiting exemplary embodiment, a paper type mode is available. The paper type mode changes the fixing temperature, the transfer current, and the linear speed of the feeding roller motor 101 in accordance with the thickness of a sheet P. The paper type of a sheet P is categorized into the following five types in accordance with the basis weight of the sheet P. Namely, a sheet P having a basis weight of about 60.2 g/m$^2$ or smaller is categorized as "Thin paper". A sheet P having a basis weight of greater than about 60.2 g/m$^2$ and not greater than about 90.2 g/m$^2$ is categorized as "Plain paper 1". A sheet P having a basis weight of greater than about 90.2 g/m$^2$ and not greater than about 104.7 g/m$^2$ is categorized as "Plain paper 2". A sheet P having a basis weight of greater than about 104.7 g/m$^2$ and not greater than about 157.0 g/m$^2$ is categorized as "Thick paper 1". A sheet P having a basis weight of greater than about 157.0 g/m$^2$ and not greater than about 209.4 g/m$^2$ is categorized as "Thick paper 2".

Table 1 below shows the fixing temperature, the transfer current, and the linear speed of the feeding roller motor 101 corresponding to the above-described five paper types.

TABLE 1

| | Fixing temperature [° C.] | Transfer current [A] | Linear speed [m/s] |
|---|---|---|---|
| Thick paper 2 | 160 | T1 | V1 |
| Thick paper 1 | 160 | T2 | V1 |
| Plain paper 2 | 165 | T3 | V1 |
| Plain paper 1 | 160 | T4 | V2 |
| Thin paper | 150 | T5 | V3 |

T1 is greater than T2. T2 is greater than T3. T3 is greater than T4. T4 is greater than T5. Namely, the greater the thickness of the sheet P is, the greater the transfer current is. V2 is about 0.3 percent faster than V1. V3 is about 0.4 percent faster than V1.

As shown in Table 1, V1 is applied to the sheet P having the basis weight of greater than about 90.2 g/m$^2$ to satisfy the above-described conditions 1 and 2. V2 and V3, which are faster than V1, are applied to the sheet P having the basis weight of about 90.2 g/m$^2$ or smaller to satisfy the above-described condition 3.

The paper type of a sheet P may also be categorized into the following three types in accordance with the basis weight of the sheet P. In this case, a sheet P having a basis weight of about 90.2 g/m$^2$ or smaller is categorized as "Thin paper". A sheet P having a basis weight of greater than about 90.2 g/m$^2$ and not greater than about 104.7 g/m$^2$ is categorized as "Plain paper". A sheet P having a basis weight of greater than about 104.7 g/m$^2$ and not greater than about 209.4 g/m$^2$ is categorized as "Thick paper". V1 is applied to the sheet P having the basis weight of greater than about 90.2 g/m$^2$ (i.e., "Plain paper" and "Thick paper"). V2 is applied to the sheet P having the basis weight of about 90.2 g/m$^2$ or smaller (i.e., "Thin paper").

A user can select the paper type mode by using a control panel (not shown) of the image forming apparatus 900 or a printer driver of a personal computer. Specifically, the user identifies the thickness of a sheet P onto which a toner image is to be formed, and then selects one of "Thick paper 2", "Thick paper 1", "Plain paper 2", "Plain paper 1", and "Thin paper" by using the control panel or the printer driver. In the image forming apparatus 900, the transfer current, the fixing temperature, and the linear speed of the feeding roller motor 101 are changed in accordance with the selected paper type to form a toner image on the sheet P.

Otherwise, the image forming apparatus 900 may further include a sensor (not shown) for detecting the thickness of a sheet P. The sensor is disposed on an upstream side of the registration roller pair 28 relative to the sheet conveyance direction. The transfer current, the fixing temperature, and the linear speed of the feeding roller motor 101 are changed based on the detection result. The sensor can be a transmission type optical sensor for detecting an amount of light transmitted through the sheet P conveyed to the sensor. A memory of the image forming apparatus 900 stores a table for associating the amount of light with the paper type. The paper type of the conveyed sheet P is determined based on the data of the table and the detection result. The transfer current, the fixing temperature, and the linear speed of the feeding roller motor 101 are changed based on the determined paper type.

As described above, according to this non-limiting exemplary embodiment, the linear speed ratio Vc/Vt of the linear speed Vc of the intermediate transfer belt 8 (depicted in FIG. 1) to the linear speed Vt of the pressing roller 62 (depicted in FIG. 3) is changed in accordance with the thickness of a sheet P serving as a recording medium. The intermediate transfer belt 8 serves as an intermediate transfer member and conveys the sheet P in the transfer unit 15 (depicted in FIG. 1). The pressing roller 62 conveys the sheet P in the fixing unit 20 (depicted in FIG. 3). The linear speed ratio Vc/Vt for conveying a thick sheet P is changed to be greater than the linear speed ratio Vc/Vt for conveying a plain paper sheet P to provide the following effects. Even when the thick sheet P is not sufficiently bent between the second transfer nip and the fixing nip when the thick sheet P enters the fixing nip, the thick sheet P is not stretched between the second transfer nip and the fixing nip. As a result, the intermediate transfer belt 8 does not rotate at the same speed as the pressing roller 62. When the tail of the thick sheet P passes the second transfer nip, backlash of the intermediate transfer belt driver 400 (depicted in FIG. 4) may not form shock jitter on a toner image on the intermediate transfer belt 8. Thus, when a toner image is continuously formed on a plurality of sheets P, shock jitter may not be formed on the second or succeeding sheet P after a toner image is transferred from the intermediate transfer belt 8 onto the sheet P.

The linear speed ratio Vr/Vc of the linear speed Vr of the registration roller pair 28 (depicted in FIG. 1) to the linear speed Vc of the intermediate transfer belt 8 is changed in accordance with the thickness of a sheet P. Specifically, the linear speed Vr of the registration roller pair 28 is set to be faster than the linear speed Vc of the intermediate transfer belt 8 to feed a plain paper sheet P. The linear speed Vr of the registration roller pair 28 is set to be slower than the linear speed Vc of the intermediate transfer belt 8 to feed a thick sheet P. Thus, the following effects are provided. When the linear speed Vr of the registration roller pair 28 is set to be faster than the linear speed Vc of the intermediate transfer belt 8 to feed a plain paper sheet P, the plain paper sheet P does not stretch between the registration nip and the second transfer nip. Thus, the plain paper sheet P is not conveyed at the second transfer nip at the same speed as the linear speed Vr of the registration roller pair 28. As a result, a shrunk toner image may not be formed on the plain paper sheet P after a toner image is transferred from the intermediate transfer belt 8 onto the plain paper sheet P. When the linear speed Vr of the registration roller pair 28 is set to be slower than the linear speed Vc of the intermediate transfer belt 8 to feed a thick sheet P, shock jitter may not be formed on a toner image transferred from the intermediate transfer belt 8 onto the thick sheet P.

The linear speed Vt of the pressing roller 62 is set to be faster than the linear speed Vr of the registration roller pair 28. Thus, a sheet P is not substantially bent between the registration nip and the fixing nip and thereby an elastic force of the bent sheet P for stretching does not increase. Therefore, even when the tail of the sheet P passes the registration nip and thereby the tail of the sheet P is not pushed by the registration roller pair 28 in the sheet conveyance direction, the weak elastic force prevents the sheet P from moving backward in the direction opposite to the sheet conveyance direction. As a result, shock jitter may not be formed on a toner image transferred on the tail of the sheet P.

The linear speed ratio Vr/Vt of the linear speed Vr of the registration roller pair 28 to the linear speed Vt of the pressing roller 62 is set to be about 0.98 or smaller. Thus, a toner image having the level of shock jitter of 3.5 or higher can be formed as illustrated in FIG. 7 and a proper toner image, on which shock jitter is hardly found, can be formed.

The linear speed ratio Vr/Vt of the linear speed Vr of registration roller pair 28 to the linear speed Vt of the pressing roller 62, which is thermally expanded up to the maximum level, is set to be about 0.98 or smaller.

The common driver, that is, the feeding roller motor 101 (depicted in FIG. 4), drives both the pressing roller 62 and the registration roller pair 28. Thus, the image forming apparatus 900 includes fewer parts and/or elements than an image forming apparatus in which the pressing roller 62 and the registration roller pair 28 are separately driven by different drivers, resulting in manufacturing cost reduction, space saving, and weight reduction.

The linear speed of the feeding roller motor 101 is changed in accordance with the thickness of a sheet P. Thus, the linear speed ratio Vr/Vc of the linear speed Vr of the registration roller pair 28 to the linear speed Vc of the intermediate transfer belt 8 and the linear speed ratio Vc/Vt of the linear speed Vc of the intermediate transfer belt 8 to the linear speed Vt of the pressing roller 62 can be changed in accordance with the thickness of the sheet P.

The linear speed Vc of the intermediate transfer belt 8 can be maintained at a predetermined speed. Thus, the linear speed of the feeding roller motor 101 can be controlled to set each of the linear speed ratio Vr/Vc of the linear speed Vr of the registration roller pair 28 to the linear speed Vc of the intermediate transfer belt 8 and the linear speed ratio Vc/Vt of the linear speed Vc of the intermediate transfer belt 8 to the linear speed Vt of the pressing roller 62 to a predetermined ratio based on the linear speed Vc of the intermediate transfer belt 8.

The linear speed ratio Vr/Vc of the linear speed Vr of the registration roller pair 28 to the linear speed Vc of the intermediate transfer belt 8 and the linear speed ratio Vc/Vt of the linear speed Vc of the intermediate transfer belt 8 to the linear speed Vt of the pressing roller 62 are set based on the basis weight of a sheet P. As illustrated in FIG. 10, the Clark stiffness increases as the basis weight increases. Namely, the sheet P has an increased stiffness. When the stiffness of the sheet P increases, an elastic force of the bent sheet P for stretching increases. To address this, a sheet P having a great basis weight is identified as "Thick paper", and the linear speed Vr of the registration roller pair 28, the linear speed Vc of the intermediate transfer belt 8, and the linear speed Vt of the pressing roller 62 are adjusted to satisfy the above-described conditions 1 and 2. In contrast, when a sheet P has a small basis weight, an elastic force of the bent sheet P for stretching is weak. Therefore, the sheet P having the small basis weight is identified as "Plain paper", and the linear speed Vr of the registration roller pair 28, the linear speed Vc of the intermediate transfer belt 8, and the linear speed Vt of the pressing roller 62 are adjusted to satisfy the above-described condition 3. As a result, a proper toner image, which is not shrunk and does not have shock jitter, can be formed on the sheet P.

To form a toner image on a sheet P having a basis weight of about 90 g/m$^2$ or smaller, the linear speed Vr of the registration roller pair 28, the linear speed Vc of the intermediate transfer belt 8, and the linear speed Vt of the pressing roller 62 are set to satisfy the above-described condition 3. Thus, a proper toner image, which is not shrunk and does not have shock jitter, can be formed.

To form a toner image on a sheet P having a basis weight of greater than about 90 g/m$^2$, the linear speed Vr of the registration roller pair 28, the linear speed Vc of the intermediate transfer belt 8, and the linear speed Vt of the pressing roller 62 are set to satisfy the above-described conditions 1 and 2. Thus, a toner image having shock jitter may not be formed on the tail of the sheet P.

According to this non-limiting exemplary embodiment, the linear speed ratio Vr/Vt of the linear speed Vr of the registration roller pair 28 to the linear speed Vt of the pressing roller 62 can be changed in accordance with the thickness of a sheet P. When the linear speed Vt of the pressing roller 62 is set to be faster than the linear speed Vr of the registration roller pair 28 to form a toner image on a thick sheet P, formation of a toner image having shock jitter on the tail of the sheet P can be suppressed. When the linear speed Vc of the intermediate transfer belt 8 is set to be slower than the linear speed Vr of the registration roller pair 28 to form a toner image on a thin sheet P, the sheet P does not stretch between the registration nip and the second transfer nip. Thus, the sheet P is not conveyed at the second transfer nip at the same speed as the linear speed Vr of the registration roller pair 28. As a result, a shrunk toner image may not be formed on the sheet P after a toner image is transferred from the intermediate transfer belt 8 onto the sheet P.

According to this non-limiting exemplary embodiment, the linear speed ratio Vc/Vt of the linear speed Vc of the intermediate transfer belt 8 to the linear speed Vt of the pressing roller 62 can be changed in accordance with the thickness of a sheet P. To form a toner image on a thick sheet P, the linear speed ratio Vc/Vt of the linear speed Vc of the intermediate transfer belt 8 to the linear speed Vt of the pressing roller 62 can be set to be greater than the linear speed ratio Vc/Vt for forming a toner image on a thin sheet P. Thus, even when the foremost head of the thick sheet P enters the fixing nip while the thick sheet P is bent less than a thin sheet P, the thick sheet P does not stretch between the second transfer nip and the fixing nip before the tail of the thick sheet P passes the second transfer nip. Namely, the thick sheet P is not conveyed at the second transfer nip at the same speed as the linear speed Vt of the pressing roller 62. Therefore, backlash of the intermediate transfer belt driver 400 may not prevent transmission of its driving force to the intermediate transfer belt 8. Thus, the intermediate transfer belt 8 may not temporarily stop rotating when the tail of the thick sheet P passes the second transfer nip. As a result, a toner image having shock jitter may not be formed on the intermediate transfer belt 8 and thereby a toner image having shock jitter may not be transferred from the intermediate transfer belt 8 onto the second or succeeding sheet P when a toner image is continuously formed on a plurality of sheets P.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming method, comprising:

forming a toner image on an image carrier of an image forming apparatus;

transferring the toner image on the image carrier onto an intermediate transfer member;

transferring the toner image on the intermediate transfer member rotating at a linear speed Vc onto a recording medium, which is fed along a first conveyance path from a registration roller pair rotating at a linear speed Vr, by a transfer member;

fixing the toner image on the recording medium, which is fed along a second conveyance path from the transfer member, by a fixing member rotating at a linear speed Vt;

determining whether the recording medium is a thin recording medium or a thick recording medium;

when the determining determines that the recording medium is the thick recording medium adjusting the linear speeds such that Vr <Vc <Vt: and when the determining determines that the recording medium is the thin recording medium, adjusting the linear speeds such that Vc <Vr <Vt, wherein a combined length of the first and second conveyance paths is shorter than a maximum length of the recording medium of the image forming apparatus.

2. The image forming method according to claim l, further comprising:

setting a linear speed ratio Vr/Vt to be not greater than 0.98 when the determining determines that the recording medium is the thick recording medium.

3. The image forming method according to claim 2, wherein the fixing comprises thermally expanding the fixing member up to a maximum level.

4. The image forming method according to claim 1, further comprising:

driving the fixing member and the registration roller pair by a common driver.

5. The image forming method according to claim 1, further comprising:

setting a linear speed ratio Vr/Vt to be 0.953 or greater when the determining determines that the recording medium is the thin recording medium.

6. The image forming method according to claim 1, further comprising:

setting a linear speed ratio Vc/Vt to be 0.949 or greater when the determining determines that the recording medium is the thin recording medium.

7. The image forming method according to claim 1, wherein the determining determines that the recording medium is the thin recording medium when the recording medium has a basis weight of 90 $g/m^2$ or smaller.

8. The image forming method according to claim 1, wherein the determining determines that the recording medium is the thick recording medium when the recording medium has a basis weight of greater than 90 $g/m^2$.

9. The image forming method according to claim 8, further comprising:

setting a linear speed ratio Vc/Vt to be greater than 0.965 and not greater than 0.972.

10. An image forming apparatus, comprising:

an image carrier configured to carry a toner image;

an intermediate transfer member configured to carry the toner image transferred from the image carrier and to rotate at a linear speed Vc;

a registration roller pair configured to rotate at a linear speed Vr and to feed a recording medium to the intermediate transfer member;

a first conveyance path configured to convey the recording medium fed by the registration roller pair to the intermediate transfer member;

a transfer member configured to transfer the toner image on the intermediate transfer member onto the recording medium;

a fixing member configured to fix the toner image on the recording medium and to rotate at a linear speed Vt; and a second conveyance path configured to convey the recording medium bearing the toner image from the intermediate transfer member to the fixing member, wherein a combined length of the first and second conveyance paths is shorter than a length of a maximum recording medium of the image forming apparatus;

a detecting unit configured to detect whether the recording medium is a thin recording medium or a thick recording medium; and means for adjusting the linear speeds such that Vr <Vc <Vt when the detecting unit detects that the recording medium is the thick recording medium, and for adjusting the linear speeds such that Vc <Vr <Vt when the detecting unit detects that the recording medium is the thin recording medium.

11. The image forming apparatus according to claim 10, further comprising:

means for setting a linear speed ratio Vr/Vt to be not greater than 0.98 when the detecting unit detects that the recording medium is the thick recording medium.

12. The image forming apparatus according to claim 10, further comprising:

a driver configured to drive the fixing member and the registration roller pair at a driving speed that is changed depending on whether the detecting unit detects that the recording medium is the thin recording medium or the thick recording medium.

13. The image forming apparatus according to claim 11, further comprising:

means for thermally expanding the fixing member up to a maximum level.

14. The image forming apparatus according to claim 12, further comprising:

means for fixing the linear speed Vc of the intermediate transfer member to a predetermined speed.

15. The image forming apparatus according to claim 10, wherein the detecting unit detects that the recording medium is the thin recording medium when the recording medium has a basis weight of about 90 $g/m^2$ or smaller.

16. The image forming apparatus according to claim 10, wherein the detecting unit detects that the recording medium is the thick recording medium when the recording medium has a basis weight of greater than about 90 $g/m^2$.

17. The image forming apparatus according to claim 16, wherein the setting unit sets a linear speed ratio Vc/Vt to be greater than 0.965 and not greater than 0.972.

18. The image forming apparatus according to claim 10, further comprising:

means for setting a linear speed ratio Vr/Vt to be 0.953 or greater when the detecting unit detects that the recording medium is the thin recording medium.

19. The image forming apparatus according to claim 10, further *comprising*:

means for setting a linear speed ratio Vc/Vt to be 0.949 or greater when the detecting unit detects that the recording medium is the thin recording medium.

* * * * *